US011591681B2

(12) United States Patent
Ueno et al.

(10) Patent No.: US 11,591,681 B2
(45) **Date of Patent: *Feb. 28, 2023**

(54) IRON-BASED SINTERED BODY

(71) Applicants: Sumitomo Electric Industries, Ltd., Osaka (JP); Sumitomo Electric Sintered Alloy, Ltd., Takahashi (JP)

(72) Inventors: Tomoyuki Ueno, Itami (JP); Koji Yamada, Itami (JP); Kazuya Takizawa, Takahashi (JP); Yuki Adachi, Takahashi (JP); Tetsuya Hayashi, Takahashi (JP)

(73) Assignees: Sumitomo Electric Industries, Ltd., Osaka (JP); Sumitomo Electric Sintered Alloy, Ltd., Takahashi (JP)

( * ) Notice: Subject to any disclaimer, the term of this patent is extended or adjusted under 35 U.S.C. 154(b) by 393 days.

This patent is subject to a terminal disclaimer.

(21) Appl. No.: 15/534,133

(22) PCT Filed: Aug. 30, 2016

(86) PCT No.: PCT/JP2016/075286
§ 371 (c)(1),
(2) Date: Jun. 8, 2017

(87) PCT Pub. No.: WO2017/051671
PCT Pub. Date: Mar. 30, 2017

(65) Prior Publication Data

US 2017/0369977 A1 Dec. 28, 2017

(30) Foreign Application Priority Data

Feb. 8, 2016 (JP) ..... JP2016-022294

(51) Int. Cl.
*C22C 49/14* (2006.01)
*C22C 38/00* (2006.01)
(Continued)

(52) U.S. Cl.
CPC ..... *C22C 49/14* (2013.01); *C22C 33/0228* (2013.01); *C22C 38/00* (2013.01);
(Continued)

(58) Field of Classification Search
CPC ..... C22C 49/14; C22C 33/0228; C22C 38/00; C22C 38/002; C22C 38/04; C22C 47/14; C22C 32/0026
See application file for complete search history.

(56) References Cited

U.S. PATENT DOCUMENTS 5,968,226 A 10/1999 Okinaka et al.
6,264,718 B1 * 7/2001 Akagi ..... C22C 33/0221 419/10
(Continued)

FOREIGN PATENT DOCUMENTS

CN 101772389 A 7/2010
CN 101772389 B * 2/2012 ..... C22C 33/0228
(Continued)

OTHER PUBLICATIONS

Longhi et al., "Fe and Mg in plagioclase", Proc. Lunar Sci. Conf. 7th (1976), p. 1281-1300 (Year: 1976).*
(Continued)

*Primary Examiner* — Humera N. Sheikh
*Assistant Examiner* — Kevin C T Li
(74) *Attorney, Agent, or Firm* — Baker Botts, L.L.P.; Michael A. Sartori

(57) ABSTRACT

An iron-based sintered body includes a metal matrix and complex oxide particles contained in the metal matrix. When a main viewing field having an area of 176 μm×226 μm is taken on a cross section of the iron-based sintered body and divided into a 5×5 array of 25 viewing fields each having an area of 35.2 μm×45.2 μm, the complex oxide particles have an average equivalent circle diameter of from 0.3 μm to 2.5
(Continued)

μm inclusive, and a value obtained by dividing the total area of the 25 viewing fields by the total number of complex oxide particles present in the 25 viewing fields is from 10 $\mu m^2$/particle to 1,000 $\mu m^2$/particle inclusive. The number of viewing fields in which no complex oxide particle is present is 4 or less out of the 25 viewing fields.

17 Claims, 23 Drawing Sheets

(51) Int. Cl.

| | |
|---|---|
| ***C22C 38/04*** | (2006.01) |
| ***C22C 47/14*** | (2006.01) |
| ***C22C 33/02*** | (2006.01) |
| *C22C 32/00* | (2006.01) |

(52) U.S. Cl.
CPC ..... *C22C 38/002* (2013.01); *C22C 38/04* (2013.01); *C22C 47/14* (2013.01); *C22C 32/0026* (2013.01)

(56) References Cited

U.S. PATENT DOCUMENTS

| | | | | |
|---|---|---|---|---|
| 10,280,488 | B2 * | 5/2019 | Ueno | C22C 33/02 |
| 2018/0202029 | A1 | 7/2018 | Ueno et al. | |

FOREIGN PATENT DOCUMENTS

| | | | | | |
|---|---|---|---|---|---|
| JP | H09-279203 | A | | 10/1997 | |
| JP | 2002-003980 | A | | 1/2002 | |
| JP | 2009035796 | A | | 2/2009 | |
| JP | 2014172238 | A | * | 9/2014 | B41J 2/16535 |
| JP | 2015172238 | A | * | 10/2015 | |

OTHER PUBLICATIONS

Notice of Allowance dated Oct. 11, 2018 issued in U.S. Appl. No. 15/741,916.
Notice of Allowability dated Feb. 21, 2019 issued in U.S. Appl. No. 15/741,916.

* cited by examiner

Sample No.1 (N=2)

Sample No.111 (N=1)

A)

B)

C)

IRON-BASED SINTERED BODY

The present application claims priority from Japanese Patent Application No. 2016-022294 filed on Feb. 8, 2016, the entire contents of which are incorporated herein by reference.

TECHNICAL FIELD

The present invention relates to an iron-based sintered body.

BACKGROUND ART

PTL 1 and PTL 2 disclose sintered bodies. Each sintered body is prepared by mixing a machinability improving powder into raw material powders including an iron-based powder in order to improve the machinability of the sintered body, subjecting the resulting powder mixture to pressure forming to form a compact, and then subjecting the compact to sintering treatment. As specific examples of the machinability improving powder, PTL 1 discloses manganese sulfide (MnS) powder and boron nitride (BN) powder, and PTL 2 discloses anorthite powder and gehlenite powder, which are $CaO—Al_2O_3—SiO_2—$ based complex oxide powders.

CITATION LIST

Patent Literature

PTL 1: Japanese Unexamined Patent Application Publication No. 2002-3980

PTL 2: Japanese Unexamined Patent Application Publication No. 9-279203

SUMMARY OF INVENTION

The iron-based sintered body of the present disclosure is an iron-based sintered body comprising a metal matrix and complex oxide particles contained in the metal matrix, wherein, when a main viewing field having an area of 176 μm×226 μm is taken on a cross section of the iron-based sintered body and divided into a 5×5 array of 25 viewing fields each having an area of 35.2 μm×45.2 μm, the complex oxide particles have an average equivalent circle diameter of from 0.3 μm to 2.5 μm inclusive, a value obtained by dividing the total area of the 25 viewing fields by the total number of complex oxide particles present in the 25 viewing fields is from 10 $\mu m^2$/particle to 1,000 $\mu m^2$/particle inclusive, and the number of viewing fields in which no complex oxide particle is present is 4 or less out of the 25 viewing fields.

DESCRIPTION OF EMBODIMENTS

Figure 1:
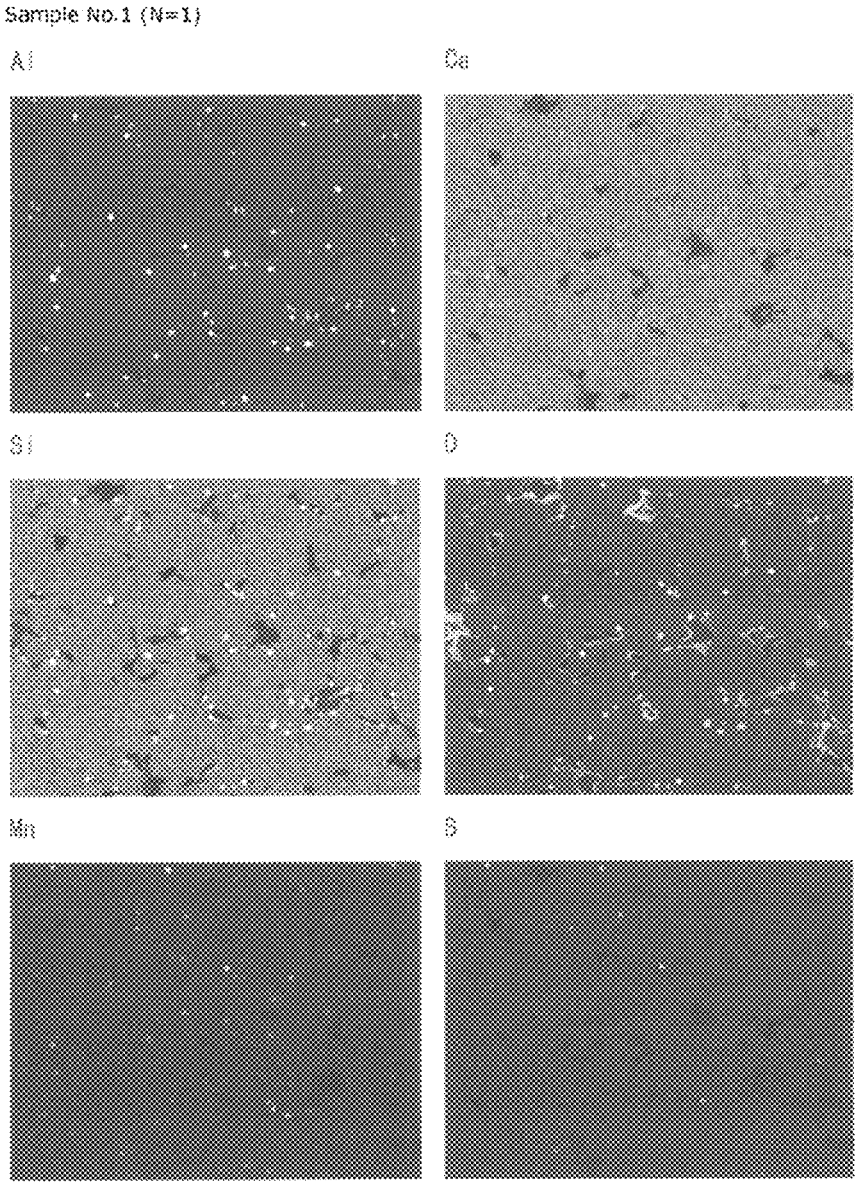
FIG. 1 shows field emission scanning electron microscope photographs showing elemental mapping (N=1) by EDX on a cross section of sample No. 1 in Test Example 1, these photographs showing the dispersion states of elements: upper left: Al, upper right: Ca, middle left: Si, middle right: O, lower left: Mn, and lower right: S.

Problems to be Solved by the Present Disclosure

When a sintered body is used for a component required to have high precision or is formed into a shape that is not easily formed by pressure forming using a die, the sintered body is required to have good machinability in order for the sintered body to be further subjected to machining such as cutting.

It is generally known that, when MnS or BN is added as a machinability improving powder in such an amount that machinability is improved, mechanical properties deteriorate. When a $CaO—Al_2O_3—SiO_2$-based complex oxide powder is added as the machinability improving powder, the following problems occur. (1) The life of a tool is rather shortened unless the conditions of machining are not optimal. (2) The complex oxide powder exhibits affinity for TiC and TiO contained in the tool and forms a protective coating. Therefore, the use of the complex oxide powder is limited to tools containing a large amount of Ti, and the complex oxide powder is not versatile. (3) The complex oxide powder actively oxidizes the tool, and this accelerates the wear of the tool.

To meet the recent demand for efficient production of automobile components, there is a desire to ensure the machinability of sintered bodies sufficiently to thereby achieve high efficiency working and extend the life of working tools. There is also a demand for the development of such sintered bodies.

Accordingly, one object of the present disclosure is to provide an iron-based sintered body excellent in machinability irrespective of the material of a tool.

Effects of the Present Disclosure

According to the present disclosure, an iron-based sintered body excellent in machinability irrespective of the material of a tool can be provided.

DESCRIPTION OF EMBODIMENTS OF THE PRESENT INVENTION

First, the details of embodiments of the present invention will be enumerated and described.

(1) An iron-based sintered body according to an embodiment of the present invention is an iron-based sintered body comprising a metal matrix and complex oxide particles contained in the metal matrix, wherein, when a main viewing field having an area of 176 μm×226 μm is taken on a cross section of the iron-based sintered body and divided into a 5×5 array of 25 viewing fields each having an area of 35.2 μm×45.2 μm, the complex oxide particles have an average equivalent circle diameter of from 0.3 μm to 2.5 μm inclusive, a value obtained by dividing the total area of the 25 viewing fields by the total number of complex oxide particles present in the 25 viewing fields is from 10 $\mu m^2$/particle to 1,000 $\mu m^2$/particle inclusive, and the number of viewing fields in which no complex oxide particle is present is 4 or less out of the 25 viewing fields.

In the above iron-based sintered body, the fine complex oxide particles having an average equivalent circle diameter of from 0.3 μm to 2.5 μm inclusive are dispersed uniformly within the range of from 10 $\mu m^2$/particle to 1,000 $\mu m^2$/particle inclusive. Therefore, the iron-based sintered body is excellent in machinability. When the complex oxide particles are uniformly dispersed in the iron-based sintered body, the following two functions (the function of preventing diffusion wear and adhesive wear and facilitation of a lubricating function) are mainly achieved. First, during cutting of the iron-based sintered body (during wet machining using a coolant), the complex oxide is heated to the temperature of the cutting edge of a cutting tool, i.e., about 400 to about 920° C., thereby softened, then covers the surface of the cutting edge of the cutting tool, and forms a coating. In this case, at least part of the coating originating from the complex oxide is interposed between the iron-based sintered body and the cutting tool. This can prevent interdiffusion of constituent elements, particularly constituent elements other than those originating from the complex oxide, between the iron-based sintered body and the cutting tool, so that the diffusion wear of the cutting tool can be reduced. Since at least part of the coating is interposed between the iron-based sintered body and the cutting tool, the adhesion of Fe to the cutting edge of the cutting tool can be prevented because the affinity of the complex oxide for Fe forming the base of the iron-based sintered body is lower than the affinity of the cutting tool for Fe, so that the adhesive wear of the cutting tool can be prevented. Specifically, at least part of the coating originating from the complex oxide has at least one of: the function as a diffusion prevention film that prevents the interdiffusion of constituent elements to thereby reduce diffusion wear; and the function as an adhesion prevention film (so-called release film) that prevents the adhesion of Fe to the cutting edge of the cutting tool to thereby reduce adhesive wear. The adhesion prevention film may also serve as a protective film that reduces mechanical rubbing wear to thereby protect the cutting edge.

Second, when heated to the temperature of the cutting edge of the tool and thereby softened, the complex oxide is stretched in the direction of cutting so as to follow the movement of the cutting edge of the tool and therefore performs the lubricating function. The direction of cutting is the direction of motion of the cutting edge of the cutting tool with respect to the workpiece (the iron-based sintered body). Since the heat-softened complex oxide performs the lubricating function, a temporal increase in cutting resistance can be prevented, and therefore the iron-based sintered body is excellent in machinability. The lubricity by the complex oxide is a mechanism that develops at 400° C. or higher which is the temperature of the cutting edge. Therefore, the complex oxide does not exhibit lubricity at the ambient temperature (250° C. or lower) of a general use environment of the iron-based sintered body. Thus, the mechanical properties of the sintered body do not deteriorate in the general use environment.

(2) In one exemplary mode of the iron-based sintered body, the iron-based sintered body contains Mn in an amount of from 0.05% by mass to 0.35% by mass inclusive, and at least part of the Mn is bonded to the complex oxide or is present as a solute in the complex oxide.

The iron-based sintered body may contain Mn in the above content range. Since Mn is hard, Mn present alone or in the form of Mn simple oxide causes deterioration in machinability and deterioration in compressibility during powder molding. This poses a problem in that it is difficult to achieve high density. Therefore, generally, Mn is removed as much as possible by refining in the course of production of raw material powders. In this mode, although Mn is contained in the above content range, the hard Mn is bonded to the complex oxide or present as a solute in the complex oxide and is heated together with the complex oxide to the temperature of the cutting edge of the cutting tool during cutting. In this case, softening is promoted, and the machinability is improved. In addition, the increase in cost due to high purity refining can be reduced. The Mn bonded to the complex oxide or present as a solute in the complex oxide is not necessarily in the form of an oxide crystal structure such as MnO.

(3) In one exemplary mode of the iron-based sintered body containing Mn, the iron-based sintered body further contains S in an amount of from 0.001% by mass to 0.02% by mass inclusive, and at least part of the S is bonded to at least one of the complex oxide and the Mn or is present as a solute in at least one of the complex oxide and the Mn.

The iron-based sintered body may contain S in the above content range. When the iron-based sintered body contains S, the machinability is likely to be improved. When S is bonded to the complex oxide or present as a solid-solute in the complex oxide, the machinability (mainly chip evacuation capability) can be improved. However, since S may cause embrittlement of the material and result in a reduction in strength, it is necessary to limit the amount of S added. When S is bonded to Mn or is present as a solute in Mn, the strength of the material is reduced. However, the machinability can be improved while the influence of S is relatively reduced.

(4) In another exemplary mode of the iron-based sintered body, in a cross section of the iron-based sintered body that includes a surface region within 10 μm from a surface of the iron-based sintered body, the complex oxide particles include irregularly shaped particles each including a buried portion buried in the metal matrix and an exposed extending portion exposed at the surface and extending in one direction from the buried portion.

The irregularly shaped particles are formed as follows. During cutting, the complex oxide is heated to the temperature of the cutting edge of the cutting tool, thereby softened, then follows the cutting edge of the cutting tool, and extends in the cutting direction. Specifically, when the irregularly shaped particles are present in the iron-based sintered body, it is considered that the complex oxide is heat-softened sufficiently at the temperature of the cutting edge. The heat-softened complex oxide follows the cutting edge of the tool to thereby provide improved lubricity and forms a coating on the surface of the cutting edge of the tool, and the diffusion wear and adhesive wear of the cutting tool can thereby be reduced.

(5) In one exemplary mode of the iron-based sintered body in which the complex oxide particles include the irregularly shaped particles, the exposed extending portion is present within 3 μm from the surface of the iron-based sintered body.

When the exposed extending portions of the irregularly shaped particles are present in the surface region of the iron-based sintered body, the machinability can be further improved through the complex oxide.

(6) In another exemplary mode of the iron-based sintered body, the complex oxide contains, in % by mass, from 4% to 35% inclusive of Si, from 2% to 25% inclusive of Al, from 2% to 35% inclusive of Ca, and from 35% to 55% inclusive of O, and the ratio of the total mass of Si, Al, Ca, and O to the total mass of the complex oxide is from 45% to 99.8% inclusive.

When the complex oxide is configured to have the specific composition, the viscosity of the complex oxide heat-softened at the temperature of the cutting edge of the cutting tool during cutting can be further effectively reduced, and the machinability can be further improved.

(7) In another exemplary mode of the iron-based sintered body, the complex oxide contains Si, Al, Ca, and O as essential elements and further contains at least one element selected from B, Mg, Na, Mn, Sr, Ti, Ba, and Zn.

When the complex oxide contains the specific elements, the viscosity of the complex oxide heat-softened at the temperature of the cutting edge of the cutting tool during cutting can be further effectively reduced, and the flowability of the complex oxide can be improved. This allows a coating to be easily formed on the cutting edge of the cutting tool, and the lubricity can be further improved, so that the machinability can be effectively improved.

(8) In another exemplary mode of the iron-based sintered body, the content, in % by mass, of the at least one element satisfies at least one of from 4% to 8% inclusive of B, from 0.5% to 15% inclusive of Mg, from 0.01% to 1% inclusive of Na, from 0.01% to 0.3% inclusive of Mn, from 0.01% to 1% inclusive of Sr, from 0.3% to 8% inclusive of Ti, from 2% to 25% inclusive of Ba, and from 5% to 45% inclusive of Zn.

In the above mode, the viscosity of the complex oxide heat-softened at the temperature of the cutting edge of the cutting tool during cutting can be further effectively reduced, and the machinability can be further improved.

(9) In another exemplary mode of the iron-based sintered body, the complex oxide contains at least 30% by mass of an amorphous component.

When the complex oxide contains at least 30% by mass of the amorphous component, the complex oxide is easily heat-softened at the temperature of the cutting edge of the cutting tool during cutting and thereby exhibits lubricity, and a coating can be easily formed on the surface of the cutting edge of the cutting tool.

(10) In another exemplary mode of the iron-based sintered body, the iron-based sintered body further contains at least one element selected from C, Cu, Ni, Cr, and Mo.

When the iron-based sintered body contains the above element, the strength of the iron-based sintered body can be improved.

(11) In one exemplary mode of the iron-based sintered body containing the at least one element selected from C, Cu, Ni, Cr, and Mo, C is contained in an amount of from 0.2% by mass to 3.0% by mass inclusive with respect to the total mass of the iron-based sintered body, and at least one element selected from Cu, Ni, Cr, and Mo is contained in a total amount of from 0.5% by mass to 6.5% by mass inclusive with respect to the total mass of the iron-based sintered body.

When C is contained in the above range, the C diffuses during sintering, and the strength of the iron-based sintered body is improved through solid solution strengthening. When the at least one element selected from Cu, Ni, Cr, and Mo is contained in the above range, sinterability can be improved, and the strength and fatigue characteristics of the iron-based sintered body can be improved.

DETAILS OF EMBODIMENT OF THE INVENTION

An iron-based sintered body according to an embodiment of the present invention will be described more specifically.

[Iron-Based Sintered Body]

The iron-based sintered body according to the embodiment includes a metal matrix and complex oxide particles contained in the metal matrix. A main feature of the iron-based sintered body according to the present embodiment is that the fine complex oxide particles are uniformly dispersed in the iron-based sintered body. This structure will be described in detail.

<<Metal Matrix>>

The metal matrix is formed from pure iron containing 99.9% by mass or more of Fe and unavoidable impurities or an Fe alloy containing an additive element with the balance being Fe and unavoidable impurities. An iron-based powder forming the metal matrix is a powder composed of particles containing Fe as a main component (the content of Fe in the iron-based powder is 99.0% by mass or more). The iron-based powder used may be, for example, a pure iron powder such as an atomized iron powder or a reduced iron powder, a pre-alloyed steel powder prepared by alloying alloy elements in advance, or a partially diffusion-alloyed steel powder prepared by alloying alloy elements through partial diffusion. These powders may be used alone or may be used as a mixture. The iron-based powder has an average particle diameter (D50 diameter: a particle diameter corresponding to 50% in a cumulative distribution curve based on mass) of from about 50 μm to about 150 μm inclusive and is contained in an amount of from 92.0% by mass to 99.9% by mass inclusive with respect to the total mass of the iron-based sintered body.

<<Complex Oxide>>

The complex oxide particles are particles of an oxide (complex oxide) containing a plurality of types of metal elements. The complex oxide particles are present uniformly in the iron-based sintered body and improve the machinability of the iron-based sintered body. Complex oxide particles at a machining point of the iron-based sintered body are heated to the temperature of the cutting edge of a tool, thereby softened, form a coating covering the surface of the cutting edge of the tool, and serve as a lubricant. The heat-softened complex oxide can prevent the diffusion wear and adhesive wear of the cutting tool and a temporal increase in cutting resistance and can improve the machinability of the iron-based sintered body. The details of the coating and lubricant originating from the complex oxide will be described later in Test Examples.

(Composition)

The complex oxide contains Si, Al, Ca, and O as essential elements and further contains at least one element selected from B, Mg, Na, Mn, Sr, Ti, Ba, and Zn. The effects of these elements and their preferred contents will next be described. The content of each element is a mass ratio with the composition of the complex oxide set to 100%.

Si

Si is an element that contributes to an improvement in the strength of the complex oxide including an amorphous phase and forms the base of the complex oxide. Si is contained in an amount of from 4% by mass to 35% by mass inclusive. When the content of Si is 4% by mass or more, the above effects can be obtained preferably. The content of Si may be 10% by mass or more and 15% by mass or more. When the content of Si is 35% by mass or less, the melting point of the complex oxide can be reduced. The content of Si may be 30% by mass or less and 20% by mass or less.

Al

Al is an element that improves the chemical durability of the complex oxide, improves the stability of the complex oxide, and increases the ability to form an amorphous phase to thereby suppress crystallization of the complex oxide. Al is contained in an amount of from 2% by mass to 25% by mass inclusive. When the content of Al is 2% by mass or more, the above effects can be obtained preferably. The content of Al may be 9% by mass or more and 12.5% by mass or more. If the content of Al is excessively large, the meltability of the complex oxide deteriorates. This causes an increase in viscosity, and the glass transition point and softening point of the complex oxide tend to increase. If the glass transition point and softening point of the complex oxide are excessively high, the complex oxide at a machining point of the iron-based sintered body is not easily heat-softened at the temperature of the cutting edge of a tool. In this case, the coating is not easily formed on the surface of the cutting edge of the tool, and the lubricating effect is unlikely to be obtained. When the content of Al is 25% by mass or less, the glass transition point and the softening point can be reduced, and the machinability of the iron-based sintered body can be improved. The content of Al may be 22% by mass or less and 15.5% by mass or less.

Ca

Ca is an element that contributes to an improvement in the stability of the complex oxide, improves its chemical durability, reduces the viscosity of the complex oxide, and contributes to an improvement in lubricity. Ca is contained in an amount of from 2% by mass to 35% by mass inclusive. When the content of Ca is 2% by mass or more, the above effects are obtained preferably. The content of Ca may be 3% by mass or more, 5% by mass or more, and particularly 12% by mass or more. When the content of Ca is 35% by mass or less, an increase in viscosity can be prevented. The content of Ca may be 30% by mass or less and 25% by mass or less.

O

O is contained in an amount of from 35% by mass to 55% by mass inclusive. When the content of O is 35% by mass or more, the stability of the complex oxide can be improved, and the chemical durability of the complex oxide can be improved. The content of O may be 40% by mass or more and 48% by mass or more. If the content of O is excessively large, coarse complex oxide is easily formed, and this affects the machinability, strength, etc. of the iron-based sintered body. When the content of O is 55% by mass or less, the machinability and strength of the iron-based sintered body can be improved. The content of O may be 54% by mass or less and 52% by mass or less.

B

B is an element that contributes to an improvement in the meltability of the complex oxide and contributes to an improvement in lubricity. B is contained in an amount of from 4% by mass to 8% by mass inclusive. When the content of B is 4% by mass or more, the above effects are obtained preferably, and the glass transition point and the softening point can be reduced. The content of B may be 4.5% by mass or more and 5% by mass or more. When the content of B is 8% by mass or less, the chemical durability of the complex oxide can be ensured. The content of B may be 7% by mass or less and 6.5% by mass or less. It should be noted that the addition of B in the form of complex oxide causes no reduction in strength at all during carburizing.

Mg

Mg is an element that contributes to an improvement in the stability of the complex oxide. Mg is contained in an amount of from 0.5% by mass to 15% by mass inclusive. When the content of Mg is 0.5% by mass or more, the above effect is obtained preferably. The content of Mg may be 1% by mass or more and 2% by mass or more. When the content of Mg is 15% by mass or less, a complex oxide including an amorphous phase can be easily formed. The content of Mg may be 12% by mass or less and 8% by mass or less.

Sr

Sr is an element that contributes to an improvement in the stability of the complex oxide and improves its coating ability. Sr is contained in an amount of from 0.01% by mass to 1% by mass inclusive. When the content of Sr is 0.01% by mass or more, the above effects are obtained preferably. The content of Sr may be 0.05% by mass or more and 0.10% by mass or more. If the content of Sr is excessively large, the above effects are not obtained. Therefore, the content of Sr is 1% by mass or less, 0.7% by mass or less, and 0.5% by mass or less.

Na

Na is an element that contributes to a reduction in glass transition point and a reduction in viscosity. Na may be contained in an amount of from 0.01% by mass to 1% by mass inclusive. The content of Na may be from 0.01% by mass to 0.8% by mass inclusive and may be from 0.015% by mass to 0.06% by mass inclusive.

Mn

Mn is an element that improves the stability of the complex oxide and improves the lubricity. Mn may be contained in an amount of from 0.01% by mass to 0.3% by mass inclusive. The content of Mn may be from 0.05% by mass to 0.25% by mass inclusive and may be from 0.1% by mass to 0.2% by mass inclusive.

Ti, Ba, and Zn

Ti, Ba, and Zn are elements that improve the stability of the complex oxide and improve the chemical durability of the complex oxide. The content of Ti may be from 0.3% by mass to 8% by mass inclusive, from 0.5% by mass to 6.5% by mass inclusive, and from 1% by mass to 5% by mass inclusive. The content of Ba may be from 2% by mass to 25% by mass inclusive, from 4% by mass to 15% by mass inclusive, and from 6% by mass to 12% by mass inclusive. The content of Zn may be from 5% by mass to 45% by mass inclusive, from 10% by mass to 35% by mass inclusive, and from 18% by mass to 25% by mass inclusive.

Among the components described above, the ratio of the total mass of Si, Al, Ca, and O to the total mass of the complex oxide is preferably from 45% to 99.8% inclusive. In this case, the viscosity of the complex oxide heat-softened at the temperature of the cutting edge of the cutting tool during cutting can be more effectively reduced, and the machinability can be further improved. The total content of Si, Al, Ca, and O with respect to the total mass of the complex oxide is more preferably from 50% to 96% inclusive and from 70% to 90% inclusive.

(Structure)

Preferably, the complex oxide contains 30% by mass or more of an amorphous component. When the complex oxide contains a large amount of the amorphous component, the complex oxide at the machining point of the iron-based sintered body is heat-softened at the temperature of the cutting edge of the tool and can thereby provide lubricity, and a coating originating from the complex oxide can be formed. The amount of the amorphous component in the complex oxide may be 50% by mass or more and 70% by mass or more, and substantially the entire complex oxide may be the amorphous component. The amorphous component in the complex oxide can be determined by identifying the locations of the complex oxide under a field emission scanning electron microscope (FE-SEM) based on the difference in contrast between the complex oxide and the iron-based base material and then examining the crystalline state in each identified location using an electron diffraction pattern under a transmission electron microscope (TEM).

Preferably, the complex oxide has a glass transition point of 725° C. or lower. The temperature of the cutting edge of a tool at a machining point of the iron-based sintered body depends on the composition of the iron-based sintered body used as a workpiece and is about 400 to about 920° C. in wet machining using a coolant. The temperature of the cutting edge is about 400° C. during steady machining. However, it is predicted that the temperature of the cutting edge increases locally and instantaneously to 600° C. or higher. Therefore, when the glass transition point of the complex oxide is 725° C. or lower, the complex oxide at the machining point of the iron-based sintered body is heat-softened at the temperature of the cutting edge of the tool. In this case, the viscosity of the complex oxide is reduced, and its flowability increases. The complex oxide thereby provides lubricity, and a coating originating from the complex oxide can be formed. The glass transition point of the complex oxide may be 680° C. or lower, 560° C. or lower, and 450° C. or lower. The temperature of the cutting edge of the tool can be measured by the following method. An optical fiber is inserted into a small hole (about 1 mm) formed in the iron-based sintered body, and the wavelength of radiation emitted from the iron-based sintered body is detected by the optical fiber. The absolute temperature of the cutting edge at the instant at which it passes through the hole is determined from the wavelength using a two-color thermometer. The glass transition point of the complex oxide can be measured by, for example, differential scanning calorimetry (DSC) or thermomechanical analysis (TMA). The glass transition point and the softening point can be derived by computations using the composition of the complex oxide and can be computed using, for example, thermodynamic equilibrium calculation software and thermodynamic database FactSage.

Preferably, the complex oxide has a softening point of 950° C. or lower. When the softening point of the complex oxide is 950° C. or lower, the flowability of the complex oxide situated at the machining point of the iron-based sintered body and heat-softened at the temperature of the cutting edge of the tool further increases. This allows lubricity to be provided to the surface of the cutting edge of the tool, and a coating originating from the complex oxide can be formed on the surface of the cutting edge. When the temperature of the cutting edge of the tool at the machining point of the iron-based sintered body is about 400 to about 920° C., the softening point of the complex oxide may be 800° C. or lower, 750° C. or lower, 600° C. or lower, and 500° C. or lower. The softening point can be measured by TMA or a kinematic viscosity measurement method.

Preferably, the viscosity of the complex oxide at the softening point is $1\times10^{7.6}$ dPa·s or less. In this case, the flowability of the complex oxide situated at the machining point of the iron-based sintered body and heat-softened at the temperature of the cutting edge of the tool can be ensured sufficiently. This allows lubricity to be provided effectively, and the surface of the cutting edge of the tool can be sufficiently coated with a coating originating from the complex oxide.

The complex oxide particles have an average equivalent circle diameter of from 0.3 μm to 2.5 μm inclusive. The average equivalent circle diameter is used when the complex oxide particles are irregularly shaped particles described later. The average equivalent circle diameter is an average equiareal circle diameter obtained by converting the areas of the irregularly shaped particles to the areas of perfect circles. Since the complex oxide particles are fine, i.e., have an average equivalent circle diameter of 2.5 μm or less, the complex oxide at the machining point of the iron-based sintered body is easily heat-softened at the temperature of the cutting edge of the tool, and therefore the machinability of the sintered body can be easily improved. Preferably, the average equivalent circle diameter of the complex oxide particles is 1.8 μm or less and 1.2 μm or less. When the average equivalent circle diameter of the complex oxide particles is 0.3 μm or more and 0.5 μm or more, the complex oxide particles are easy to handle in their production process.

(Dispersion State)

When a main viewing field having an area of 176 μm×226 μm is taken on a cross section of the iron-based sintered body and divided into a 5×5 array of 25 viewing fields each having an area of 35.2 μm×45.2 μm, the complex oxide satisfies the following. The iron-based sintered body obtained by an iron-based sintered body production method described later has substantially the same structure over its entire volume, so that any cross section of the iron-based sintered body and any viewing fields can be used. The cross section and the viewing fields are taken preferably from an inner region at least 0.5 mm from the surface of the iron-based sintered body and more preferably from an inner region at least 1 mm from the surface.

A value obtained by dividing the total area of the 25 viewing fields by the total number of complex oxide particles present in the 25 viewing fields is from 10 $\mu m^2$/particle to 1,000 $\mu m^2$/particle inclusive. When the above value is 10 $\mu m^2$/particle or more, the complex oxide is present uniformly in the iron-based sintered body. In this case, the probability that the cutting edge of the cutting tool comes into contact with the complex oxide during cutting of the iron-based sintered body is high. Therefore, a coating originating from the complex oxide is always formed on the surface of the cutting edge of the tool. This allows the complex oxide to provide lubricity more efficiently, and the machinability of the iron-based sintered body can thereby be improved. When the amount of the complex oxide present is excessively large, the relative amount of the metal matrix becomes small, and the strength is reduced. Therefore, when the above value is 1,000 $\mu m^2$/particle or less, the strength of the iron-based sintered body can be ensured. The above value is preferably from 12 $\mu m^2$/particle to 620 $\mu m^2$/particle inclusive and from 60 $\mu m^2$/particle to 450 $\mu m^2$/particle inclusive.

The number of viewing fields in which no complex oxide particle is present is 4 or less out of the 25 viewing fields. When the above number of viewing fields is 4 or less, the complex oxide is present uniformly in the iron-based sintered body. The smaller the number of viewing fields in which no complex oxide particle is present, the more uniformly the complex oxide is distributed in the iron-based sintered body. Therefore, the number of viewing fields in which no complex oxide particle is present is preferably 3 or less, 2 or less, and 1 or less. In particular, it is most preferable that the complex oxide particles are present in all the viewing fields and the number of viewing fields in which no complex oxide particle is present is zero. The phrase "no complex oxide particle is present" means that no complex oxide particles can be detected even at an analysis level when a field emission scanning electron microscope (FE-SEM) with a resolution of about 300 nm at a magnification of 3,000× is used.

Preferably, the number of viewing fields in which at least two complex oxide particles are present is 15 or more. In this case, the complex oxide is more uniformly distributed in the iron-based sintered body, and the machinability can be further improved. The number of viewing fields in which at least two complex oxide particles are present is preferably 17 is more and 20 is more, and it is particularly preferable that at least two complex oxide particles are present in all the viewing fields.

A 2×2 array of 4 viewing fields is selected from the 25 viewing fields such that the 2×2 array includes no viewing field in which the complex oxide is not present, and the selected 2×2 array is referred to as a medium viewing field. Preferably, the number of complex oxide particles present in the medium viewing field is 5 or more. In this case, the complex oxide is more uniformly distributed in the iron-based sintered body, and the machinability can be further improved. The number of complex oxide particles present in the medium viewing field is more preferably 7 or more and 9 or more.

(Shape)

In a cross section of the iron-based sintered body that includes a surface region within 10 μm from the surface of the iron-based sintered body, the complex oxide particles include irregularly shaped particles each including a buried portion buried in the metal matrix and an exposed extending portion exposed at the surface and extending in one direction from the buried portion. Preferably, the exposed extending portion is present within 3 μm from the surface of the iron-based sintered body. The irregularly shaped particles are formed as follows. During cutting of the iron-based sintered body, the complex oxide is heated to the temperature of the cutting edge of a cutting tool, thereby softened, then follows the cutting edge of the cutting tool, and extends in the cutting direction. The cutting direction can be roughly determined from streak-like tool marks on the machined surface. The cutting direction is a direction of the plastic flow of the iron structure when a cross section is observed under an SEM (a grinding direction when grinding is performed). The details of the irregularly shaped particles will be later described in Test Examples.

<<Others>>

The iron-based sintered body may further contain at least one element selected from C, Cu, Ni, Cr, and Mo. When the iron-based sintered body contains C, C diffuses during sintering, and the strength of the iron-based sintered body can be improved through solid solution strengthening. C may be contained in an amount of from 0.2% by mass to 3.0% by mass inclusive with the amount of the iron-based sintered body set to 100% by mass. When the iron-based sintered body contains at least one metal element selected from Cu, Ni, Cr, and Mo, sinterability can be improved, and the strength and fatigue properties of the iron-based sintered body can be improved. These metal elements may be contained in a total amount of from 0.5% by mass to 6.5% by mass inclusive with the amount of the iron-based sintered body set to 100% by mass. When the iron-based sintered body contains Cu, the content of Cu may be from 0.5% by mass to 3.0% by mass inclusive.

The iron-based sintered body may contain Mn and S. Mn and S originate from the iron-based powder forming the metal matrix. Mn may be contained in the range of from 0.05% by mass to 0.35% by mass inclusive with the amount of the iron-based sintered body set to 100% by mass. Preferably, at least part of Mn is bonded to the complex oxide or is present as a solute in the complex oxide. When the hard Mn is bonded to the complex oxide or is present as a solute in the complex oxide, the Mn is heated together with the complex oxide to the temperature of the cutting edge of a cutting tool during cutting and is thereby softened. In this case, the heat-softened complex oxide provides lubricity, and the machinability can thereby be improved. The Mn does not cause oxidation of the tool. Since the step of removing the hard Mn by refining can be omitted, an increase in cost can be prevented. S may be contained in the range of from 0.001% by mass to 0.02% by mass inclusive. Preferably, at least part of S is bonded to at least one of the complex oxide and the Mn or is present as a solute in at least one of the complex oxide and the Mn. When S is bonded to the complex oxide or is present as a solute in the complex oxide, the machinability (mainly chip evacuation capability) can be improved. However, since S may cause embrittlement of the material and result in a reduction in strength, it is necessary to limit the amount of S added. When S is bonded to Mn or is present as a solute in Mn, the strength of the material is reduced. However, the machinability can be improved while the influence of S is relatively reduced.

Applications

The iron-based sintered body in the embodiment can be suitably used as various iron-based sintered bodies, e.g., for oil pump components, variable valve mechanism components, and various automobile components such as gears that require high dimensional accuracy.

[Method for Producing Iron-Based Sintered Body]

The iron-based sintered body in the embodiment can be produced typically through the steps of preparing raw material powders, mixing the raw material powders to produce a powder mixture, subjecting the powder mixture to compression molding to produce a compact, and sintering the compact to produce the sintered body.

Preparation of Raw Material Powders

An iron-based powder and a complex oxide powder are prepared as raw material powders. If necessary, a graphite powder, at least one non-Fe metal powder selected from Cu, Ni, Cr, and Mo powders, and an organic substance used as a forming lubricant are prepared. When a graphite powder is prepared, the graphite powder may have an average particle diameter of from about 2 μm to about 30 μm inclusive and may be contained in an amount of from 0.2% by mass to 3.0% by mass inclusive with respect to the total amount of the raw material powders. When at least one non-Fe metal powder selected from Cu, Ni, Cr, and Mo powders is prepared, the at least one non-Fe metal powder may have an average particle diameter of from about 10 μm to about 100 μm inclusive and may be contained in an amount of from 0.5% by mass to 6.5% by mass inclusive with respect to the total amount of the raw material powders. The complex oxide powder can be produced typically through the steps of producing a frit of the complex oxide, coarsely grinding the frit to produce a coarse powder, finely grinding the coarse powder to produce a fine powder, and mixing the fine powder and the iron-based powder to thereby produce a powder mixture (an iron-based powder for powder metallurgy).

Production of Complex Oxide Frit

A complex oxide containing Si, Al, Ca, O and at least one element selected from B, Mg, Na, Mn, Sr, Ti, Ba, and Zn in specific ranges is heated to its melting point or higher and then cooled to produce a complex oxide frit. The contents of these elements are the same as those of the complex oxide particles described above. The heating temperature may be appropriately set according to the composition of the complex oxide and may be about 1,000 to about 1,700° C.

Production of Coarse Powder by Coarsely Grinding Frit

The above complex oxide frit is coarsely ground to an average particle diameter of 20 μm or more to produce a coarse complex oxide powder. The coarse grinding may be, for example, mechanical milling using a jaw crusher, a roll crusher, a stamp mill, a brown mill, or a ball mill.

Production of Fine Powder by Finely Grinding Coarse Powder

The above coarse complex oxide powder is finely ground to a prescribed particle diameter to produce a fine powder. The fine grinding is performed using an airflow mill that use no grinding media. The airflow mill used may be, for example, a jet mill. The fine grounding using no grinding media can prevent contamination, allows the coarse complex oxide powder to be ground while no coarse particles remain, and can prevent excessively fine grinding.

Production of Powder Mixture by Mixing Fine Powder and Iron-Based Powder

The prepared raw material powders are mixed to produce a powder mixture. These powders are mixed using a mixer with a shear force capable of breaking aggregates of the fine powder. These powders are forcibly stirred and mixed. The mixer used may be, for example, a double cone mixer, a stirring mixer, or an eccentric mixer. By forcibly stirring and mixing these powders, the fine complex oxide powder can be uniformly dispersed in the iron-based powder. By dispersing the fine complex oxide having a larger specific surface area than the iron-based powder uniformly in the iron-based powder, the fine complex oxide can easily react with at least part of Mn or its oxide that may be contained in the iron-based powder. Moreover, the probability that the cutting edge of a cutting tool comes into contact with the complex oxide during cutting of the iron-based sintered body subjected to sintering is high. Therefore, a coating originating from the complex oxide is always formed on the surface of the cutting edge of the tool. This allows the complex oxide to provide lubricity more efficiently, and the machinability of the iron-based sintered body can thereby be improved. When the powders are mixed together, a two-stage mixing method may be used which includes: mixing the complex oxide powder with at least part of the iron-based powder serving as the main component or with a graphite powder having a specific gravity relatively close to that of the complex oxide to thereby prepare a preliminary powder mixture; and then mixing the preliminary powder mixture with the iron-based powder and the non-Fe metal powder.

Production of Compact

The above powder mixture is filled into a die and subjected to compression molding to produce a compact. The molding pressure is, for example, from about 400 MPa to 1,200 MPa inclusive. By adjusting the shape of the die used, a compact having a complicated shape can be obtained.

Production of Sintered Body

The above compact is sintered under the conditions of a temperature of from about 1,000° C. to about 1,350° C. inclusive in a nitrogen or converted gas atmosphere for from about 10 minutes to about 120 minutes inclusive to thereby produce a sintered body.

TEST EXAMPLES

Iron-based sintered bodies each including a metal matrix and complex oxide particles contained in the metal matrix were produced, and the dispersion state of the complex oxide in each iron-based sintered body and its machinability were examined.

[Production of Samples]

Samples Nos. 1 to 6 and 101

An iron-based powder, a graphite powder, a Cu powder, and complex oxide powders were prepared as raw material powders. In the iron-based powder used, 0.18% by mass of Mn and 0.004% by mass of S were contained in Fe. The average particle diameter of the iron-based powder was 74.55 μm. In this Test Example, the average particle diameter is a D50 diameter (a particle diameter corresponding to 50% in a cumulative distribution curve based on mass) measured by the Microtrac method (laser diffraction-scattering method). The iron-based powder had a D10 diameter (a particle diameter corresponding to 10% in the cumulative distribution curve based on mass) of 31.39 μm, a D95 diameter (a particle diameter corresponding to 95% in the cumulative distribution curve based on mass) of 153.7 μm, and a maximum diameter of 228.2 μm. The average particle diameter, i.e., the D50 diameter, of the graphite powder was 28 μm. The average particle diameter, i.e., the D50 diameter, of the Cu powder was 30 μm.

The complex oxide powders used were composed of complex oxides having compositions shown in Table 1. Contents in each complex oxide shown in Table 1 are mass ratios with the composition of the complex oxide set to 100%. The average particle diameter, i.e., the D50 diameter, of each complex oxide powder was 0.87 μm. Each complex oxide powder had a D10 diameter of 0.55 μm, a D95 diameter of 3.30 μm, and a maximum particle diameter of 10.09 μm. Each complex oxide powder was produced by heating a complex oxide having one of the above compositions to its melting point or higher, cooling the complex oxide to produce a frit of the complex oxide, coarsely grinding the frit of the complex oxide using a ball mill, and then finely grinding the resulting complex oxide using a jet mill. For each of the obtained complex oxide powders, the locations of the complex oxide were identified based on the difference in contrast between the complex oxide and an iron-based base material, and the crystalline state in each identified location was examined using an electron diffraction pattern under a transmission electron microscope (TEM). The amount of an amorphous component in the complex oxide was found to be 35% by mass.

The above powders were prepared such that the mass ratio of the iron-based powder:the Cu powder:the graphite powder:one of the complex oxide powders was 97.1:2.0:0.8:0.1, and a forming lubricant was added such that the ratio of the mass of the forming lubricant to the total mass of the powders was 0.8%. The prepared powders were mixed using a stirring mixer to produce a powder mixture (an iron-based powder for powder metallurgy). When the powders are mixed, no organic substance used as the forming lubricant may be mixed, and the lubricant may be applied to a die.

The powder mixture obtained was filled into the die and pressurized and compressed at a molding pressure of 700 MPa to thereby produce a cylindrical compact having an outer diameter of φ60 mm×an inner diameter of φ10 mm×a height of 40 mm.

The compacts obtained were subjected to heat treatment in a converted gas atmosphere at 1,130° C.×15 minutes to produce sintered bodies (samples Nos. 1 to 6 and 101).

TABLE 1

| Sample No. | Contents in complex oxide (% by mass) | | | | | | | | | | | | Total of Si, Al, Ca, O | Glass transition point (° C.) | Softening point (° C.) |
|---|---|---|---|---|---|---|---|---|---|---|---|---|---|---|---|
| | Si | Al | B | Mg | Ca | Sr | Na | K | O | Ti | Ba | Zn | | | |
| 1 | 20 | 15 | 5 | 2 | 4 | 0.2 | 0.3 | — | 50 | 0.5 | 3 | — | 89.0 | 550 | 740 |
| 2 | 12 | 21 | — | 0.5 | 29 | — | 0.5 | — | 37 | — | — | — | 99.0 | 720 | 920 |
| 3 | 16 | 17 | 6 | 3 | 3 | 0.01 | 0.1 | — | 49 | 1.4 | 4.5 | — | 85.0 | 720 | 820 |
| 4 | 14 | 10 | — | — | 13 | — | — | — | 38 | 6 | — | 19 | 75.0 | 665 | 780 |
| 5 | 7 | 4 | 6 | 11 | 3 | — | — | — | 40 | — | 20 | 9 | 54.0 | 610 | 700 |
| 6 | 5 | 3 | 7 | — | 5 | — | — | — | 35 | — | 5 | 40 | 48.0 | 490 | 590 |
| 101 | 36.5 | — | 6.4 | — | — | — | — | 1.1 | 56 | — | — | — | 92.5 | 730 | 1000 |

Sample No. 111

Sample No. 111 uses an iron-based powder for powder metallurgy containing the above-described iron-based powder, the graphite powder, and the Cu powder as raw material powders and containing no complex oxide powder. The other conditions are the same as those of sample No. 1.

Test Example 1: Dispersion State of Complex Oxide in Iron-Based Sintered Body The dispersion states of complex oxides in iron-based sintered bodies were examined. In this Example, samples Nos. 1, 2, and 111 were used as representatives of the samples, and the dispersion states of complex oxides in the iron-based sintered bodies of these samples were examined. In particular, for each of the iron-based sintered bodies of samples Nos. 1 and 2, the following two types of tests were performed to check reproducibility. In the first type, two different cross sections were taken from each iron-based sintered body, and one main viewing field was taken on each of the cross sections to perform a test (the test performed on one of the two cross sections is denoted by N=1, and the test performed on the other cross section is denoted by N=2). In the second type, an iron-based sintered body different from the iron-based sintered body subjected to the first type of test was produced, and one cross section was taken from the produced iron-based sintered body. One main viewing field is taken on the cross section, and a test was performed on the main viewing field (the test performed on the different iron-based sintered body is denoted by N=3). The same test method was used for both the types.

<<Dispersion State of Complex Oxide>>

Figure 11:
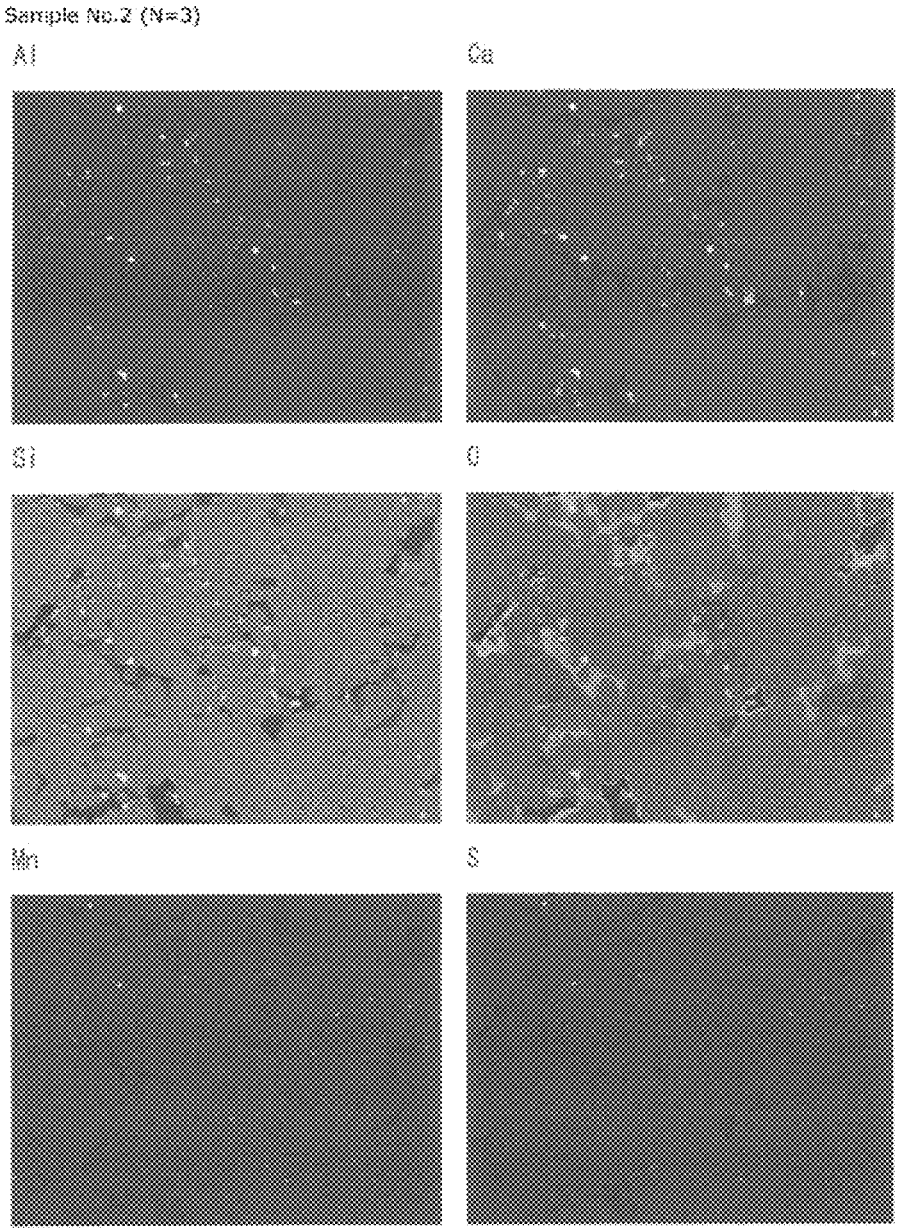
FIG. 11 shows field emission scanning electron microscope photographs showing elemental mapping (N=3) by EDX on a cross section of sample No. 2 in Test Example 1, these photographs showing the dispersion states of elements: upper left: Al, upper right: Ca, middle left: Si, middle right: O, lower left: Mn, and lower right: S.
Figure 12:
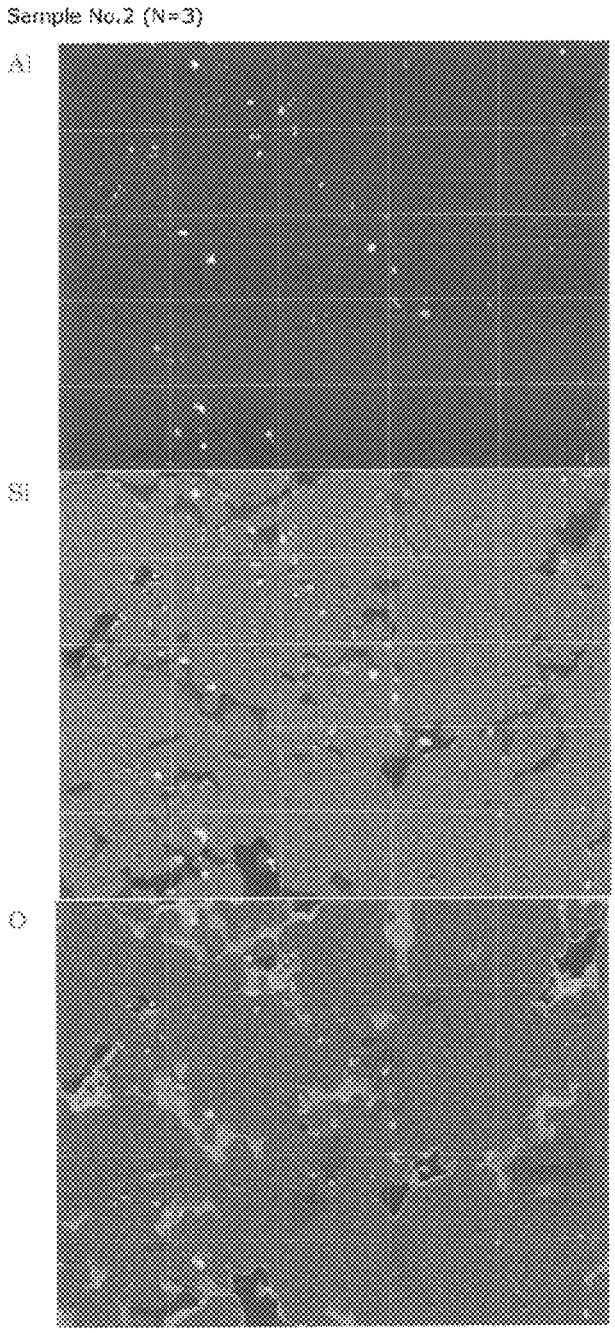
FIG. 12 shows pictures illustrating the dispersion states of complex oxide in FIG. 11.
Figure 13:
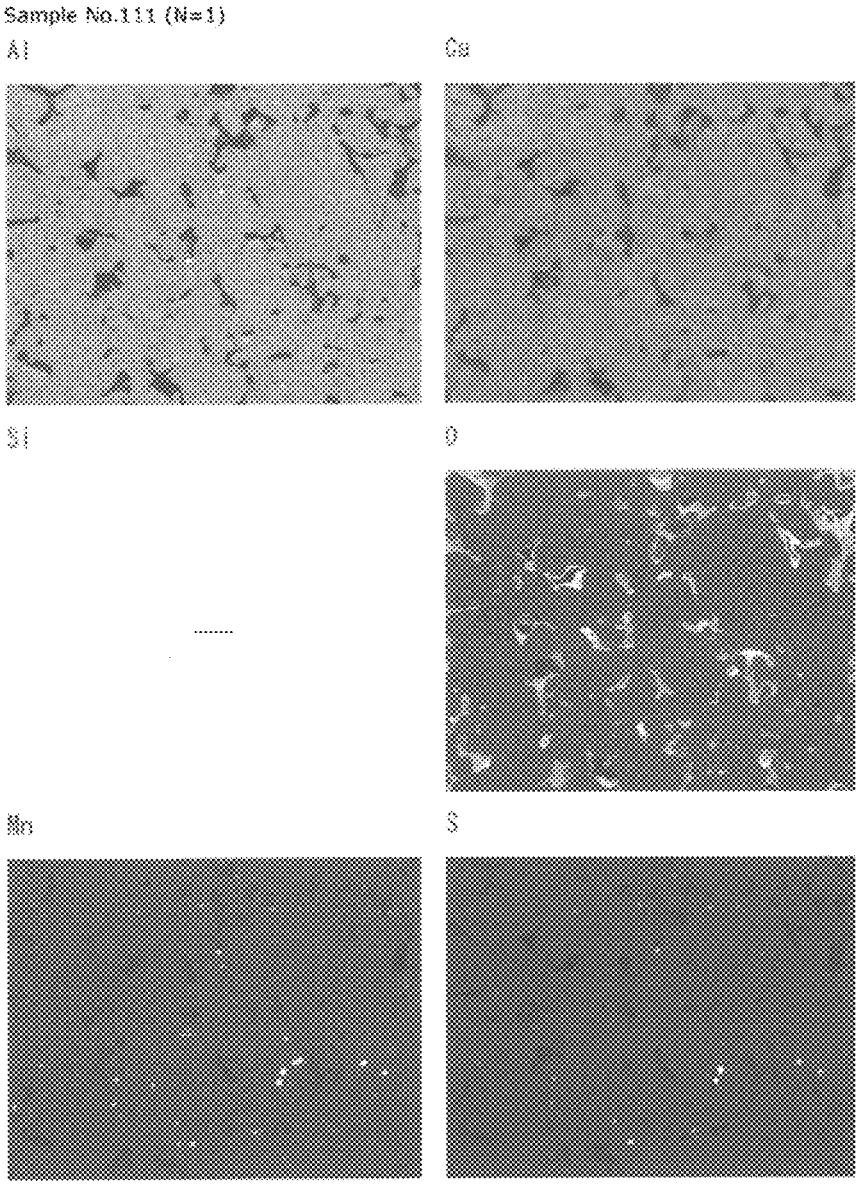
FIG. 13 shows field emission scanning electron microscope photographs showing elemental mapping by EDX on a cross section of sample No. 111 in Test Example 1, these photographs showing the dispersion states of elements: upper left: Al, upper right: Ca, middle right: O, lower left: Mn, and lower right: S.
Figure 14:
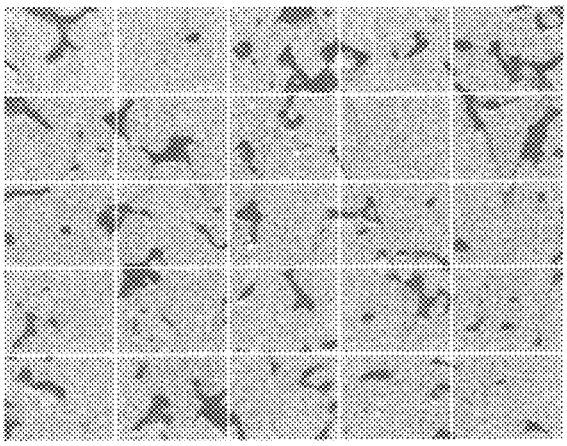
FIG. 14 shows pictures illustrating the dispersion states of Al, O in FIG. 13.
Figure 14:
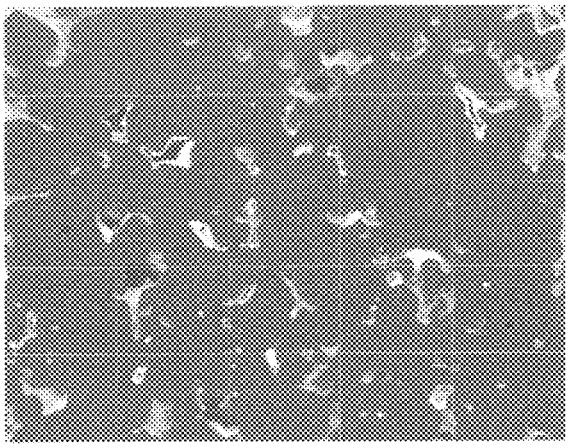

Each of the obtained iron-based sintered bodies of samples Nos. 1, 2, and 111 was cut using a cross section polisher to take a cross section, and the cross section was observed under a field emission scanning electron microscope (FE-SEM). The complex oxide can be identified based on elements contained therein. Specifically, a main viewing field having an area of 176 μm×226 μm was taken and divided into a 5×5 array of 25 viewing fields each having an area of 35.2 μm×45.2 μm, and composition analysis was performed through elemental mapping at 3,000× by energy-dispersive X-ray spectroscopy (EDX). The resolution of the EDX analysis at the above magnification is about 0.03 μm, and the analysis was performed under the condition of an acceleration voltage of 15 kV. Elements were selected and extracted from the obtained mapping images using image processing software (Image-Pro Plus manufactured by Media Cybernetics), and then the number and area were computed for each of the elements. FIGS. 1 to 6 show the elemental mapping of sample No. 1, and FIGS. 7 to 12 show the elemental mapping of sample No. 2. FIGS. 13 and 14 show the elemental mapping of sample No. 111. In each figure, white dots represent regions in which an element to be analyzed is present. The image processing software used is not limited to that described above, and any software having the same function as the above software may be used.

Figure 2:
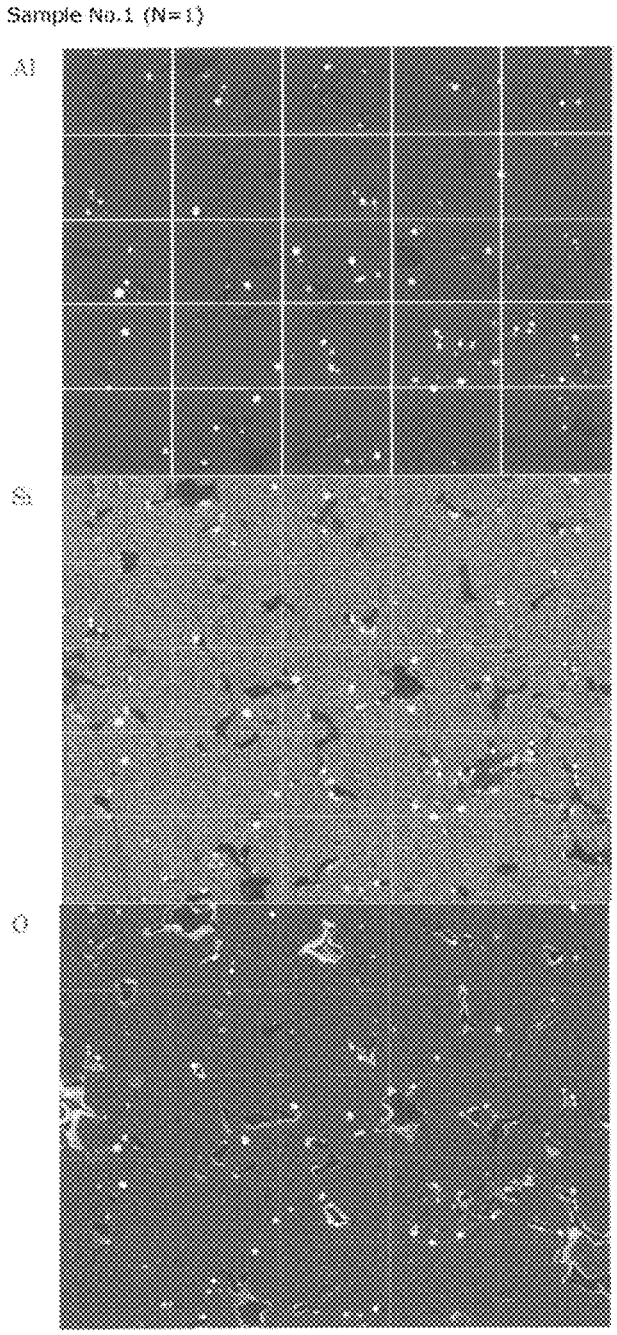
FIG. 2 shows pictures illustrating the dispersion states of complex oxide in FIG. 1.

FIG. 1 shows the elemental mapping of Al, Ca, Si, O, Mg, and Na in the complex oxide in sample No. 1 (N=1) and the elemental mapping of Mn and S contained in the iron-based sintered body. As can be seen from FIG. 1, O and at least two elements selected from Al, Ca, Si are present at the same positions. Specifically, the complex oxide present in the iron-based sintered body contains O and at least two elements selected from Al, Ca, and Si. As can be seen from FIG. 1, most of Al, Ca, Si, and O are present at the same positions, and the complex oxide present in the iron-based sintered body contains Al, Ca, Si, and O. As can be seen, at least part of Mg and Na are present at the same positions as Al, Ca, Si, and O, and these elements form the complex oxide. FIG. 2 shows the elemental mapping of Al, Si, and O as representatives of the elements of the complex oxide in sample No. 1 (N=1). The vertical and horizontal lines in FIG. 2 represent boundaries between coupled viewing fields among a 5×5 array of 25 viewing fields. As can be seen from FIG. 2, Al, Si, and O (the complex oxide) are present in all the viewing fields. In particular, at least two complex oxide particles are present in 21 out of the 25 viewing fields. Among the 25 viewing fields, a 2×2 array of 4 viewing fields is defined as a medium viewing field. In sample No. 1 (N=1), 16 medium viewing fields are present. At least 9 complex oxide particles are present in each of the medium viewing fields, and this shows that the complex oxide is uniformly distributed. The image processing software was used to compute the quotient of the total area of the 25 viewing fields divided by the total number of complex oxide particles present in the 25 viewing fields, and the quotient was 250 $\mu m^2$/particle. The average equivalent circle diameter of the complex oxide particles was obtained using the image processing software and was 0.85 μm. The average equivalent circle diameter was obtained by determining the equivalent circle diameters of all the complex oxide particles present in the 25 viewing fields and then computing the average of the equivalent circle diameters of all the complex oxide particles. As can be seen from the above results, the fine complex oxide particles are uniformly dispersed in the iron-based sintered body of sample No. 1 (N=1).

Figure 3:
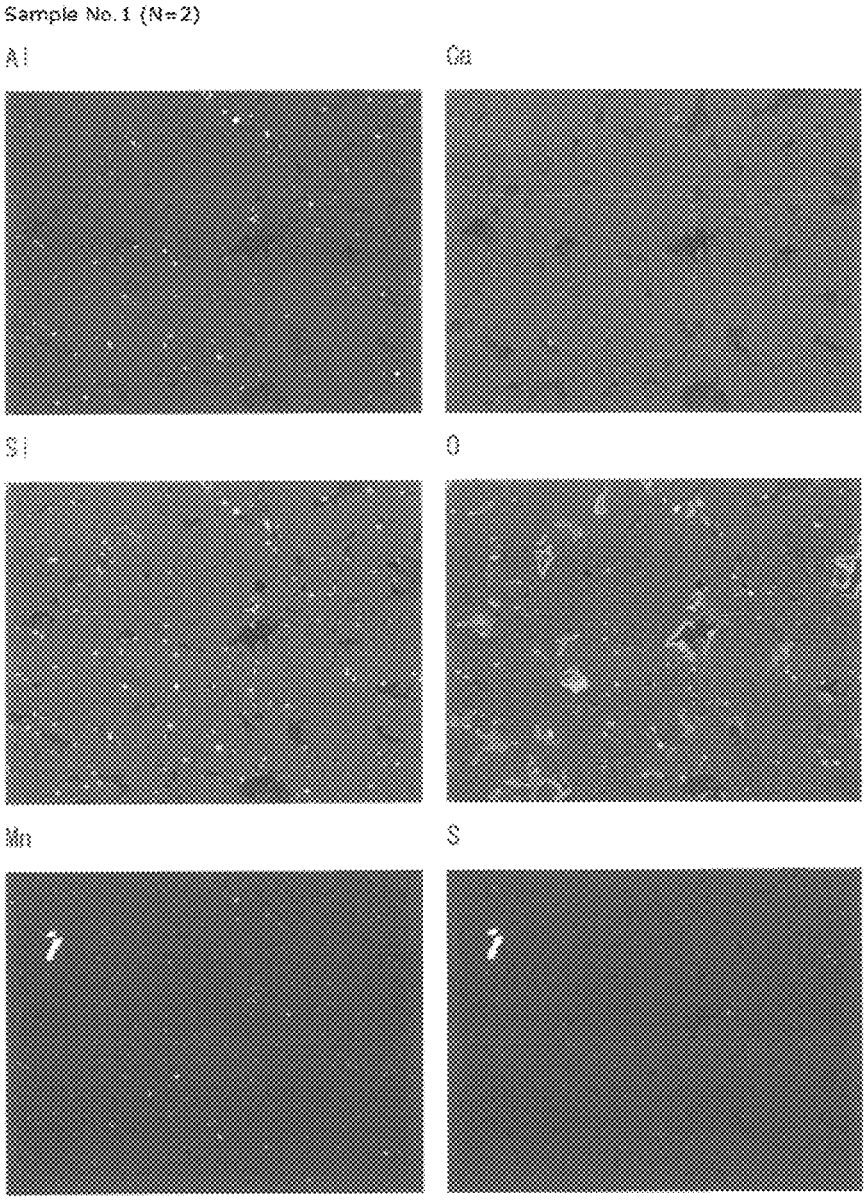
FIG. 3 shows field emission scanning electron microscope photographs showing elemental mapping (N=2) by EDX on a cross section of sample No. 1 in Test Example 1, these photographs showing the dispersion states of elements: upper left: Al, upper right: Ca, middle left: Si, middle right: O, lower left: Mn, and lower right: S.
Figure 4:
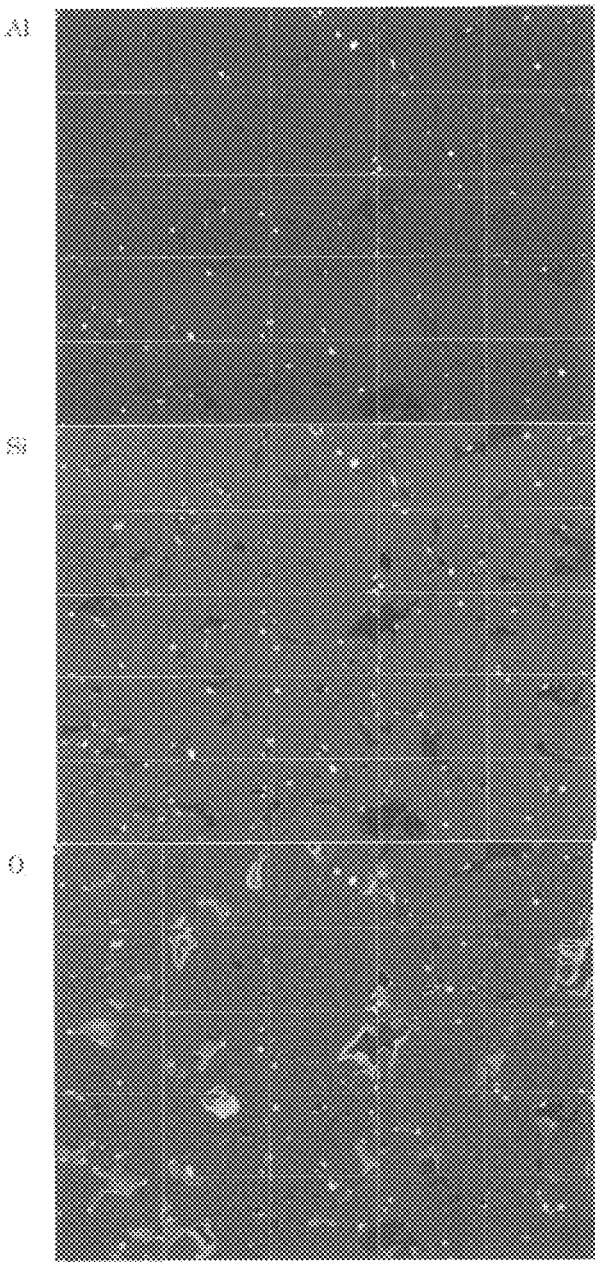
FIG. 4 shows pictures illustrating the dispersion states of complex oxide in FIG. 3.
Figure 5:
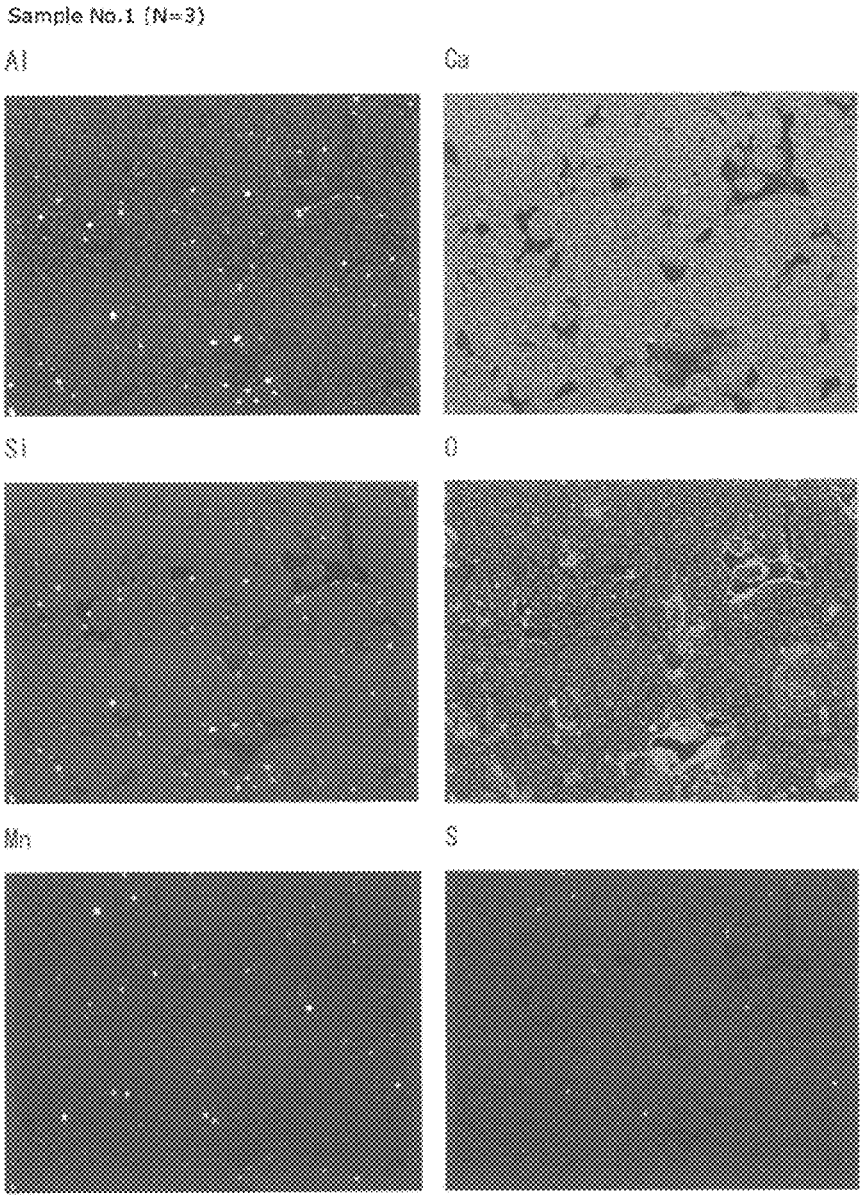
FIG. 5 shows field emission scanning electron microscope photographs showing elemental mapping (N=3) by EDX on a cross section of sample No. 1 in Test Example 1, these photographs showing the dispersion states of elements: upper left: Al, upper right: Ca, middle left: Si, middle right: O, lower left: Mn, and lower right: S.
Figure 6:
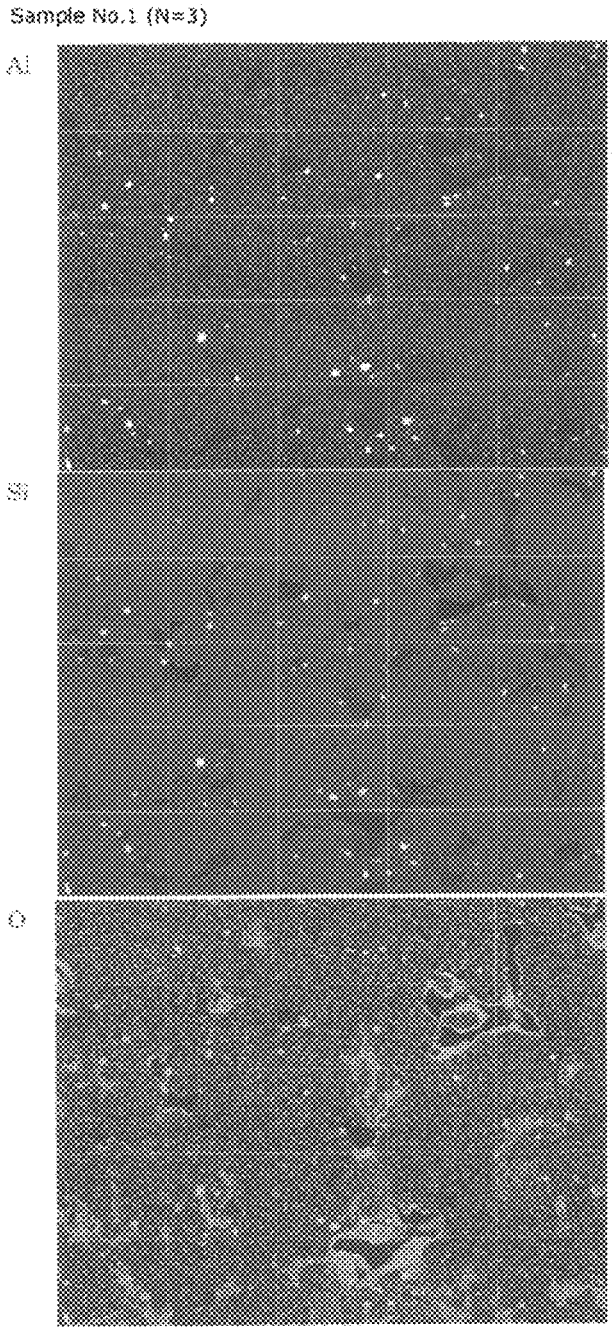
FIG. 6 shows pictures illustrating the dispersion states of complex oxide in FIG. 5.

To check the reproducibility of the test, the same test was repeated another two times on the iron-based sintered body of sample No. 1. FIG. 3 shows the elemental mapping of Al, Ca, Si, and O in the complex oxide in sample No. 1 (N=2) and the elemental mapping of Mn and S contained in the iron-based sintered body, and FIG. 4 shows the elemental mapping of Al, Si, and O as representatives of the elements of the complex oxide in sample No. 1 (N=2). FIG. 5 shows the elemental mapping of Al, Ca, Si, and O in the complex oxide in sample No. 1 (N=3) and the elemental mapping of Mn and S contained in the iron-based sintered body, and FIG. 6 shows the elemental mapping of Al, Si, and O as representatives of the elements of the complex oxide in sample No. 1 (N=3). As can be seen from FIGS. 3 and 5, in both N=2 and 3, O and at least two elements selected from Al, Ca, and Si are present at the same positions. In particular, most of Al, Ca, Si, and O are present at the same positions. As can be seen from FIGS. 4 and 6, Al, Si, and O (the complex oxide) are present in all the viewing fields. At least two complex oxide particles are present in 21 out of the 25 viewing fields, and at least 9 complex oxide particles are present in each of the 2×2 medium viewing fields in the 25 viewing fields. This shows that the complex oxide is uniformly distributed. The image processing software was used to compute the quotient of the total area of the 25 viewing fields divided by the total number of complex oxide particles present in the 25 viewing fields, and the quotient was 282 $\mu m^2$/particle for N=2 and 260 $\mu m^2$/particle for N=3. The average equivalent circle diameter of the complex oxide particles obtained using the image processing software and was 0.72 μm for N=2 and 0.61 μm for N=3. As can be seen from the above results, the fine complex oxide particles are uniformly dispersed in the iron-based sintered body of sample No. 1 (N=1 to 3).

Figure 7:
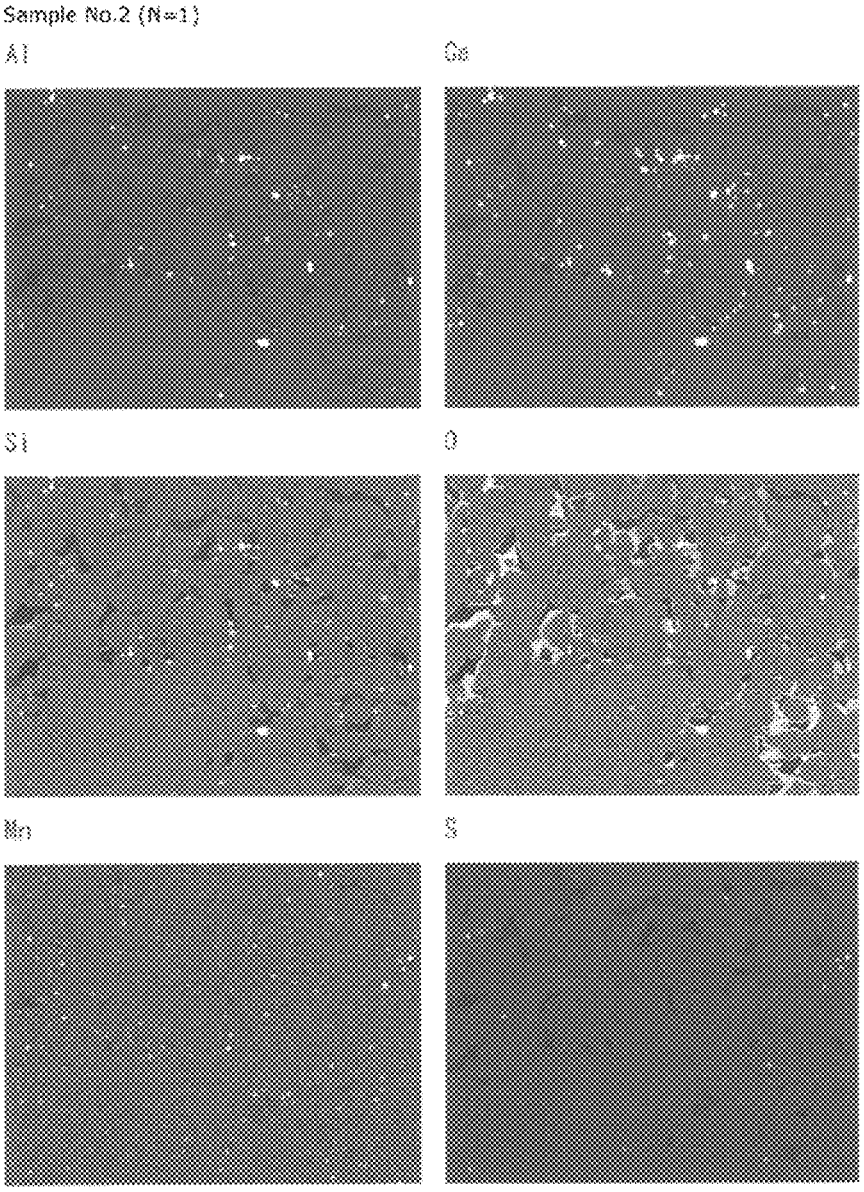
FIG. 7 shows field emission scanning electron microscope photographs showing elemental mapping (N=1) by EDX on a cross section of sample No. 2 in Test Example 1, these photographs showing the dispersion states of elements: upper left: Al, upper right: Ca, middle left: Si, middle right: O, lower left: Mn, and lower right: S.
Figure 8:
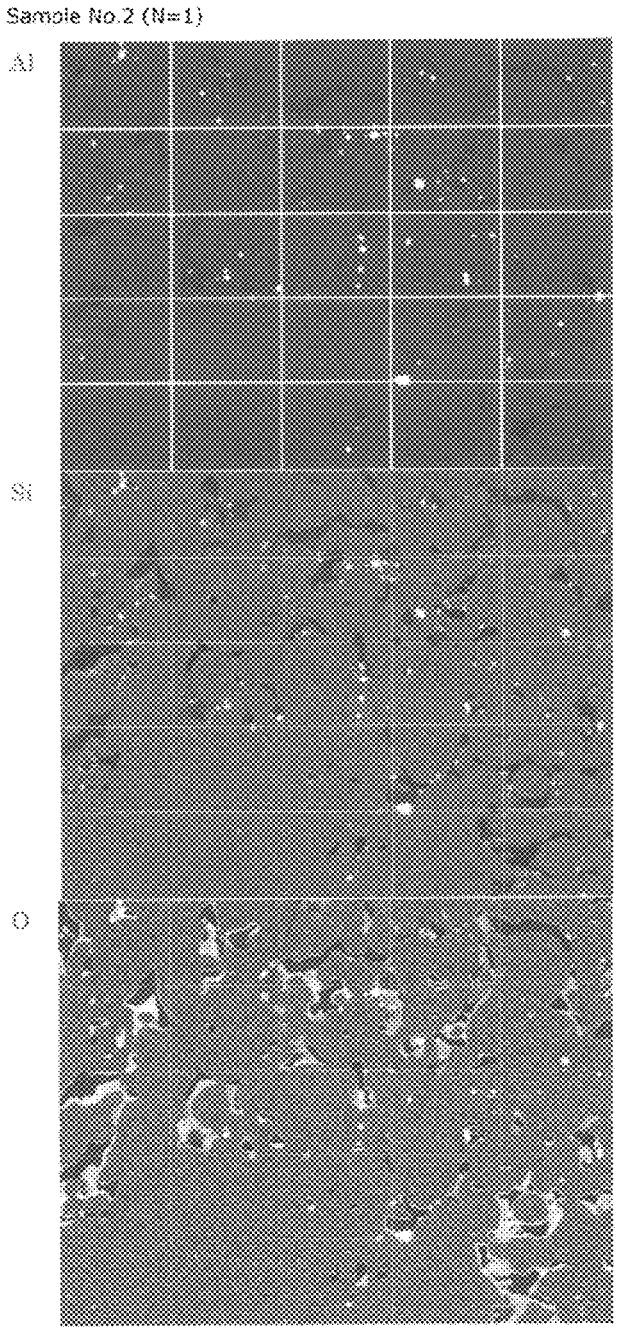
FIG. 8 shows pictures illustrating the dispersion states of complex oxide in FIG. 7.

FIG. 7 shows the elemental mapping of Al, Ca, Si, and O in the complex oxide in sample No. 2 (N=1) and the elemental mapping of Mn and S contained in the iron-based sintered body. As can be seen from FIG. 7, O and at least two elements selected from Al, Ca, and Si are present at the same positions. Specifically, the complex oxide present in the iron-based sintered body contains O and at least two elements selected from Al, Ca, and Si. As can be seen from FIG. 7, most of Al, Ca, Si, and O are present at the same positions, and the complex oxide present in the iron-based sintered body contains Al, Ca, Si, and O. FIG. 8 shows the elemental mapping of Al, Si, and O as representatives of the elements of the complex oxide in sample No. 2 (N=1). The vertical and horizontal lines in FIG. 8 represent boundaries between coupled viewing fields among a 5×5 array of 25 viewing fields. As can be seen from FIG. 8, Al, Si, and O (the complex oxide) are present in 21 out of the 25 viewing fields. Specifically, the number of viewing fields in which no complex oxide is present is 4. In particular, at least two complex oxide particles are present in 19 out of the 25 viewing fields. A 2×2 array of 4 viewing fields selected from the 25 viewing fields such that the 2×2 array includes no viewing field in which the complex oxide is not present is defined as a medium viewing field. In sample No. 2 (N=1), 10 medium viewing fields are present, and at least 5 complex oxide particles are present in each of these medium viewing fields. This shows that the complex oxide is uniformly distributed. The image processing software was used to compute the quotient of the total area of the 25 viewing fields divided by the total number of complex oxide particles present in the 25 viewing fields, and the quotient was 379 $\mu m^2$/particle. The average equivalent circle diameter of the complex oxide particles was obtained using the image processing software and was 1.11 μm. As can be seen from the above results, also in the iron-based sintered body of sample No. 2 (N=1), the fine complex oxide particles are uniformly dispersed.

Figure 9:
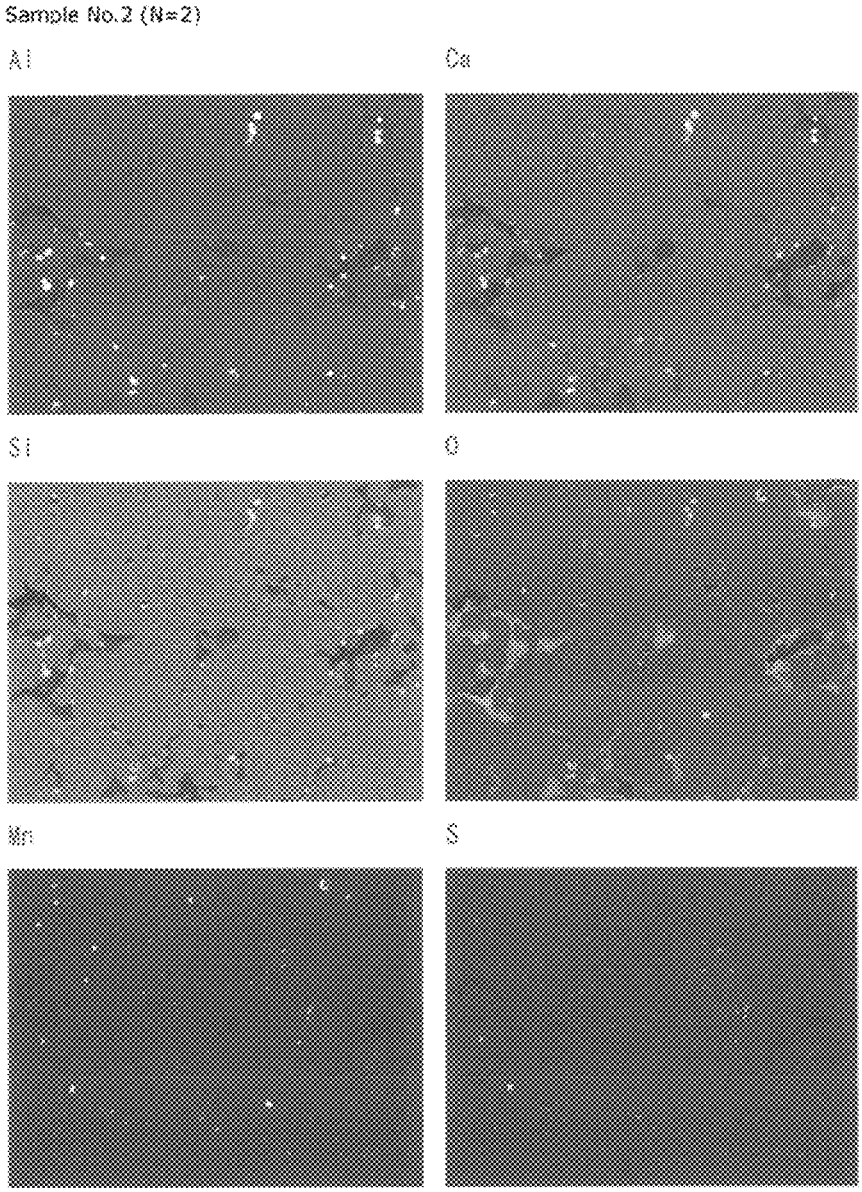
FIG. 9 shows field emission scanning electron microscope photographs showing elemental mapping (N=2) by EDX on a cross section of sample No. 2 in Test Example 1, these photographs showing the dispersion states of elements: upper left: Al, upper right: Ca, middle left: Si, middle right: O, lower left: Mn, and lower right: S.
Figure 10:
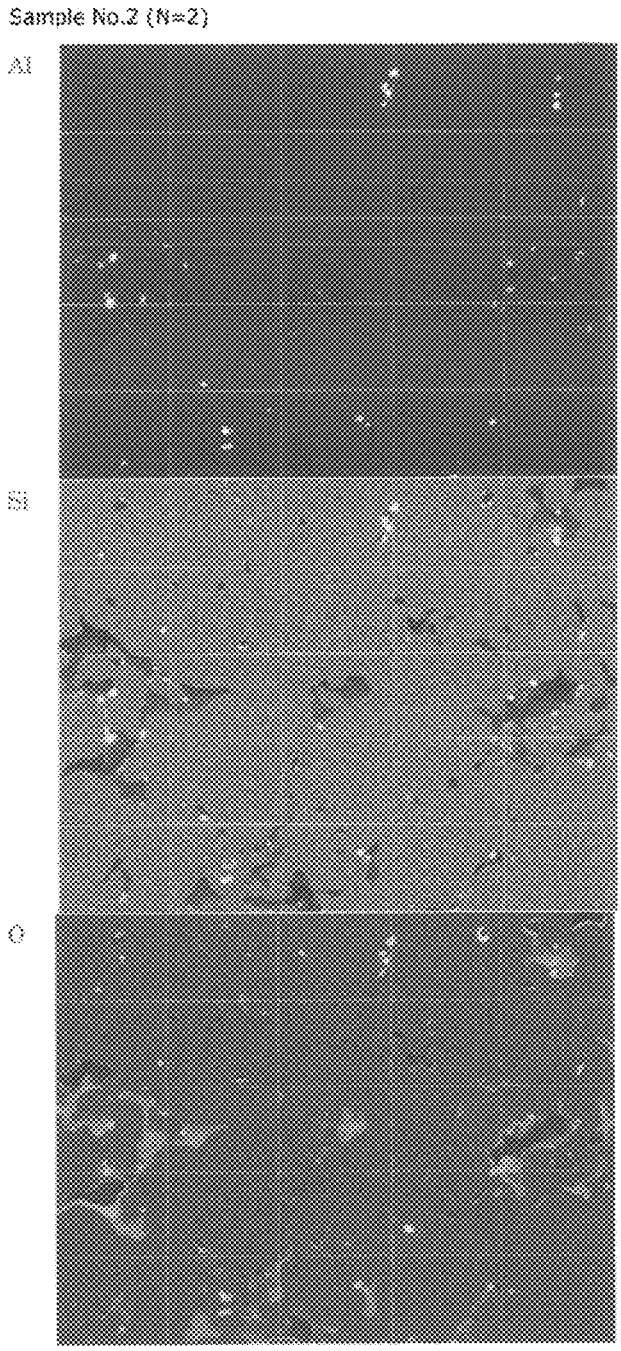
FIG. 10 shows pictures illustrating the dispersion states of complex oxide in FIG. 9.

To check the reproducibility of the test, the same test was repeated another two times on the iron-based sintered body of sample No. 2. FIG. 9 shows the elemental mapping of Al, Ca, Si, and O in the complex oxide in sample No. 2 (N=2) and the elemental mapping of Mn and S contained in the iron-based sintered body, and FIG. 10 shows the elemental mapping of Al, Si, and O as representatives of the elements of the complex oxide in sample No. 2 (N=2). FIG. 11 shows the elemental mapping of Al, Ca, Si, and O in the complex oxide in sample No. 2 (N=3) and the elemental mapping of Mn and S contained in the iron-based sintered body, and FIG. 12 shows the elemental mapping of Al, Si, and O as representatives of the elements of the complex oxide in sample No. 2 (N=3). As can be seen from FIGS. 9 and 11, in both N=2 and 3, O and at least two elements selected from Al, Ca, and Si are present at the same positions. In particular, most of Al, Ca, Si, and O are present at the same positions. As can be seen from FIGS. 10 and 12, the number of viewing fields in which Al, Si, and O (the complex oxide) are present is 22 out of the 25 viewing fields for N=2 and 21 out of the 25 viewing fields for N=3, and the number of viewing fields in which no complex oxide is present is 4 or less. A 2×2 array of viewing fields selected from the 25 viewing fields such that the 2×2 array includes no viewing field in which the complex oxide is not present is defined as a medium viewing field. For N=2, at least 6 complex oxide particles are present in each medium viewing field (10 medium viewing fields are present). For N=3, at least 9 complex oxide particles are present in each medium viewing field (8 medium viewing fields are present). This shows that the complex oxide is distributed uniformly. The image processing software was used to compute the quotient of the total area of the 25 viewing fields divided by the total number of complex oxide particles present in the 25 viewing fields, and the quotient was 428 $\mu m^2$/particle for N=2 and 258 $\mu m^2$/particle for N=3. The average equivalent circle diameter of the complex oxide particles was obtained using the image processing software and was 1.19 μm for N=2 and 0.95 μm for N=3. As can be seen from the above results, the fine complex oxide particles are uniformly dispersed in the iron-based sintered body of sample No. 2 (N=1 to 3).

FIG. 13 shows the elemental mapping of Al, Ca, O, Mn, and S in sample No. 111. As can be seen from FIG. 13, although slight amounts of Al and O are present, no Ca is present. FIG. 14 shows the elemental mapping of Al and O in sample No. 111. The vertical and horizontal lines in FIG. 14 represent boundaries between coupled viewing fields among a 5×5 array of 25 viewing fields. As can be seen from FIG. 14, Al and O are present in 4 out of the 25 viewing fields. The Al is present in a slight amount as a contaminant but is not present in the form of complex oxide as in samples Nos. 1 and 2. This is because the raw materials contain Al as an unavoidable impurity and alumina is used as abrasive grains when the iron-based sintered body is polished. The image processing software was used to compute the quotient of the total area of the 25 viewing fields divided by the total number of Al particles present in the 25 viewing fields, and the quotient was 0 $\mu m^2$/particle. It was impossible to compute the average equivalent circle diameter of the Al particles using the image processing software.

<<Form of Mn Present>>

As can be seen from the elemental mapping of Al, Ca, Si, O, Mn, and S shown in FIGS. 1, 3, 5, 7, 9, and 11, in samples Nos. 1 and 2 each containing a specific amount of complex oxide, part of Mn and S are present at the same positions, and part of Mn and the complex oxide (Al, Ca, Si, and O) are present at the same positions. As can be seen from the elemental mapping of Al, Ca, O, Mn, and S in FIG. 13, in sample No. 111 containing no complex oxide, Mn and S are present at the same positions. As can be seen from the above results, when no complex oxide is contained, Mn present is bonded to S or forms a solid solution with S. However, when a complex oxide is contained, part of Mn is bonded to the complex oxide or is present as a solute in the complex oxide, and the rest of the Mn is bonded to S or forms a solid solution with S.

Test Example 2: Machinability of Iron-Based Sintered Bodies

Each of the obtained sintered bodies of samples Nos. 1 to 6, 101, and 111 were subjected to a cutting test.

<<Mechanical Properties>>

For each of the sintered bodies of samples Nos. 1 to 6, 101, and 111, test pieces for mechanical property tests were produced to measure Rockwell hardness HRB, Vickers hardness Hv, transverse rupture strength TRS, and tensile strength a. The Rockwell hardness B scale HRB was measured using a commercial hardness meter. The transverse rupture strength TRS was measured using a three-point bending method. Sample No. 1 had an HRB of 85.5, an Hv of 2.91 GPa, a TRS of 815 MPa, and a σ of 551 MPa. Sample No. 101 had an HRB of 85.4, an Hv of 2.91 GPa, a TRS of 817 MPa and a σ of 531 MPa. Sample No. 111 had an HRB of 85.6, an Hv of 2.92 GPa, a TRS of 815 MPa, a σ of 533 MPa. The HRB, Hv, TRS, and σ of each of samples Nos. 2 to 6 were substantially the same as the HRB, Hv, TRS, and σ of sample No. 1. As can be seen from these results, the presence or absence of the complex oxide does not affect the mechanical properties of the sintered bodies.

Each of the sintered bodies of samples Nos. 1 to 6, 101, and 111 was subjected to carburizing at 900° C., quenching, and then tempering at 200° C., and then the transverse rupture strength TRS and the tensile strength σ were measured in the manner described above. Sample No. 1 had a TRS of 972 MPa and a σ of 653 MPa, and sample No. 101 had a TRS of 886 MPa and a σ of 625 MPa. Sample No. 111 had a TRS of 887 MPa and a σ of 676 MPa. The TRS and σ of each of samples Nos. 2 to 6 after quenching and tempering were substantially the same as the TRS and σ of sample No. 1 after quenching and tempering. As can be seen from these results, sample No. 101 containing the complex oxide powder having a softening point of 1,000° C. and sample No. 111 containing no complex oxide powder were strengthened through quenching and tempering, and samples Nos. 1 to 6 each containing a complex oxide powder having a softening point of 950° C. or lower were strengthened through quenching and tempering, as were samples Nos. 101 and 111. Samples Nos. 1 to 6 were found to have good hardenability.

<<Cutting Test 1>>

A side surface of each of the sintered bodies of samples Nos. 1 to 6, 101, and 111 was cut using a lathe. The cutting conditions are as follows. Various cutting tools were used, and wet cutting was performed using a cutting speed of 200 m/min, a feed of 0.1 mm/rev, and a cutting depth of 0.2 mm. The cutting tools used were a cutting tool with a cemented carbide-made insert having a nose radius of 0.8 mm and a rake angle of 0°, a cutting tool with a cermet-made insert having a nose radius of 0.8 mm and a rake angle of 0°, and a cutting tool with a CBN-made insert having a nose radius of 1.2 mm and a rake angle of 0°. For the cemented carbide and the cermet, a cutting length of 2,500 mm was used. For the CBN, a cutting length of 4,500 mm was used.

Amount of Wear of Flank of Cutting Tool

Figure 15:
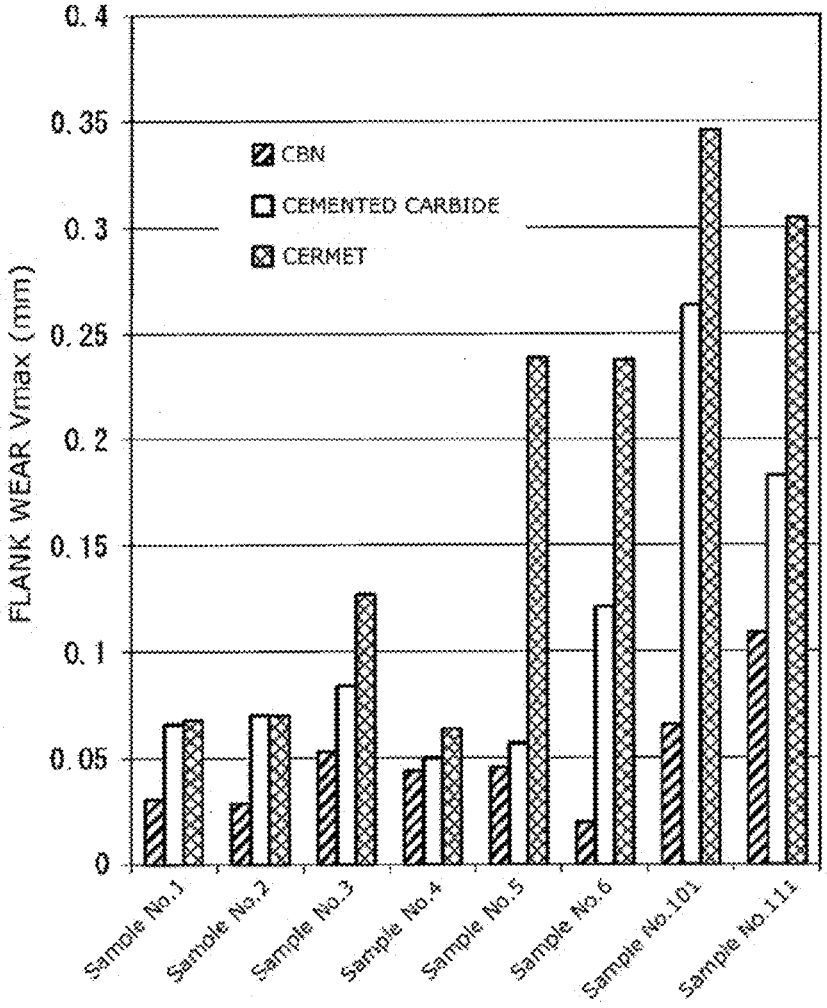
FIG. 15 is a graph showing the results of cutting test 1.

For each of the cemented carbide-made, cermet-made, and CBN-made cutting tools, the amount of wear of the flank of the cutting tool after cutting was measured. After cutting, the cutting edge of the cutting tool was observed under a toolmaker's microscope, and the amount or wear was measured using a micrometer. The results are shown in FIG. 15. In FIG. 15, the horizontal axis represents sample No., and the vertical axis represents the amount of wear of each of the cutting tools used for cutting the samples. For sample No. 1, a CBN-made cutting tool containing Ti and a CBN-made cutting tool containing no Ti were used to perform the cutting test. The results showed that the effect of improving the machinability was achieved irrespective of whether or not Ti was contained. In particular, this effect was higher when the tool containing no Ti was used. Therefore, the test results obtained using CBN-made cutting tools containing no Ti-based sintered materials at all, i.e., containing no Ti, are shown.

As can be seen from the results in FIG. 15, when any one of the above cutting tools was used to cut samples Nos. 1 to 6 each containing a complex oxide powder having a softening point of 950° C. or lower, the amount of wear of the flank was smaller than that when the cutting tool was used to cut sample No. 101 containing the complex oxide powder having a softening point of 1,000° C. and sample No. 111 containing no complex oxide powder. When the cemented carbide-made cutting tool was used to cut samples Nos. 1 to 6, the reduction in the amount of wear of the flank relative to that when sample No. 101 was cut was about 75% for sample No. 1, about 73% for sample No. 2, about 68% for sample No. 3, about 80% for sample No. 4, about 78% for sample No. 5, and about 55% for sample No. 6. Similarly, when the cemented carbide-made cutting tool was used to cut samples Nos. 1 to 6, the reduction in the amount of wear of the flank relative to that when sample No. 111 was cut was about 65% for sample No. 1, about 62% for sample No. 2, about 55% for sample No. 3, about 73% for sample No. 4, about 70% for sample No. 5, and about 35% for sample No. 6. When the CBN-made cutting tool was used to cut samples Nos. 1 to 6, the reduction in the amount of wear of the flank relative to that when sample No. 101 was cut was about 53% for sample No. 1, about 55% for sample No. 2, about 20% for sample No. 3, about 33% for sample No. 4, about 30% for sample No. 5, and about 70% for sample No. 6. Similarly, when the CBN-made cutting tool was used to cut samples Nos. 1 to 6, the reduction in the amount of wear of the flank relative to that when sample No. 111 was cut was about 72% for sample No. 1, about 73% for sample No. 2, about 50% for sample No. 3, about 60% for sample No. 4, about 58% for sample No. 5, and about 82% for sample No. 6. When the cermet-made cutting tool was used to cut samples Nos. 1 to 6, the reduction in the amount of wear of the flank relative to that when sample No. 101 was cut was about 80% for sample No. 1, about 80% for sample No. 2, about 63% for sample No. 3, about 82% for sample No. 4, about 30% for sample No. 5, and about 30% for sample No. 6. Similarly, when the cermet-made cutting tool was used to cut samples Nos. 1 to 6, the reduction in the amount of wear of the flank relative to that when sample No. 111 was cut was about 78% for sample No. 1, about 77% for sample No. 2, about 58% for sample No. 3, about 80% for sample No. 4, about 22% for sample No. 5, and about 22% for sample No. 6.

As can be verified from the results in FIG. 15, when samples Nos. 1 to 6 were cut, the effect of improving the machinability was found for all the cutting tools including the cemented carbide-made, cermet-made, and CBN-made cutting tools necessary for cutting the iron-based sintered bodies. The effect of improving the machinability was found to be sufficient even for the CBN-made cutting tool containing no Ti (such as TiC) at all. Specifically, when samples Nos. 1 to 6 are cut, no limitation is imposed on the material of the cutting tool used. Therefore, a wide variety of cutting tools can be used, and high versatility is achieved.

Moreover, the effect of improving the machinability was obtained when the cemented carbide-made tool or the cermet-made cutting tool was used to cut samples Nos. 1 to 6 at a cutting speed of 100 m/min. When the CBN-made cutting tool was used to cut samples Nos. 1 to 6, the same effect was obtained even at cutting speeds of 300 m/min and 400 m/min. Specifically, when samples Nos. 1 to 6 are cut, the effect of improving the machinability can be achieved over a wide range of cutting speed (100 to 400 m/min).

Observation of Cutting Edge of Cutting Tool

Figure 16:
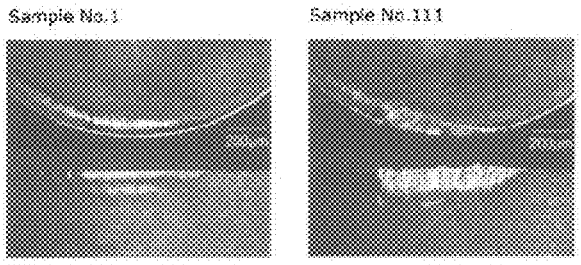
FIG. 16 shows toolmaker's microscope photographs showing cutting edges of cutting tools after cutting in cutting test 1.

As an example, the cutting edges of cemented carbide-made cutting tools were observed after cutting. FIG. 16 shows toolmaker's microscope photographs of the cutting edge of a cutting tool used to cut sample No. 1 and the cutting edge of a cutting tool used to cut sample No. 111. In FIG. 16, rake faces are shown in the upper halves, and flanks are shown in the lower halves. In the cutting edge of the cutting tool used to cut sample No. 1, almost no adhesive wear was found. However, in the cutting edge of the cutting tool used to cut sample No. 111, significant adhesive wear was found to occur. In the cutting edges of cutting tools used to cut samples Nos. 2 to 6, almost no adhesive wear was found, as in the case of cutting sample No. 1. In the cutting edge of a cutting tool used to cut sample No. 101, significant adhesive wear was found to occur, as in the case of cutting sample No. 111.

Figure 17:
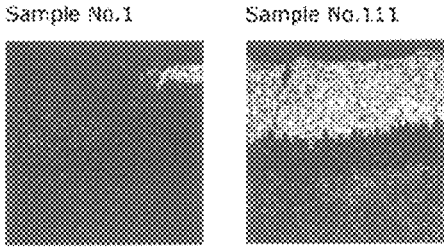
FIG. 17 shows field emission scanning electron microscope photographs showing the flanks of the cutting tools after cutting in cutting test 1.

One reason that the cutting edge of a cutting tool undergoes adhesive wear is as follows. At a machining point of a sintered body, interdiffusion of constituent elements of the sintered body and constituent elements of the cutting tool occurs at the temperature of the cutting edge of the tool, and the constituent elements of the sintered body adhere to the cutting tool. Therefore, adherents on the surfaces of cutting tools were examined. FIG. 17 shows field emission scanning electron microscope photographs (150×) of the flank of a cutting tool used to cut sample No. 1 and the flank of a cutting tool used to cut sample No. 111. No adherents were found on the flank of the cutting tool used to cut sample No. 1. However, thick adherents were found on the flank of the cutting tool used to cut sample No. 111. As a result of analysis of the adherents, Fe was detected in the adherents. It is considered that Fe forming the base of the sintered body serving as a workpiece adheres to the flank. No adherents were found on the flanks of the cutting tools used to cut samples No. 2 to 6, as in the case of cutting sample No. 1. Thick adherents were found on the flank of the cutting tool used to cut sample No. 101, as in the case of cutting sample No. 111.

Figure 18:
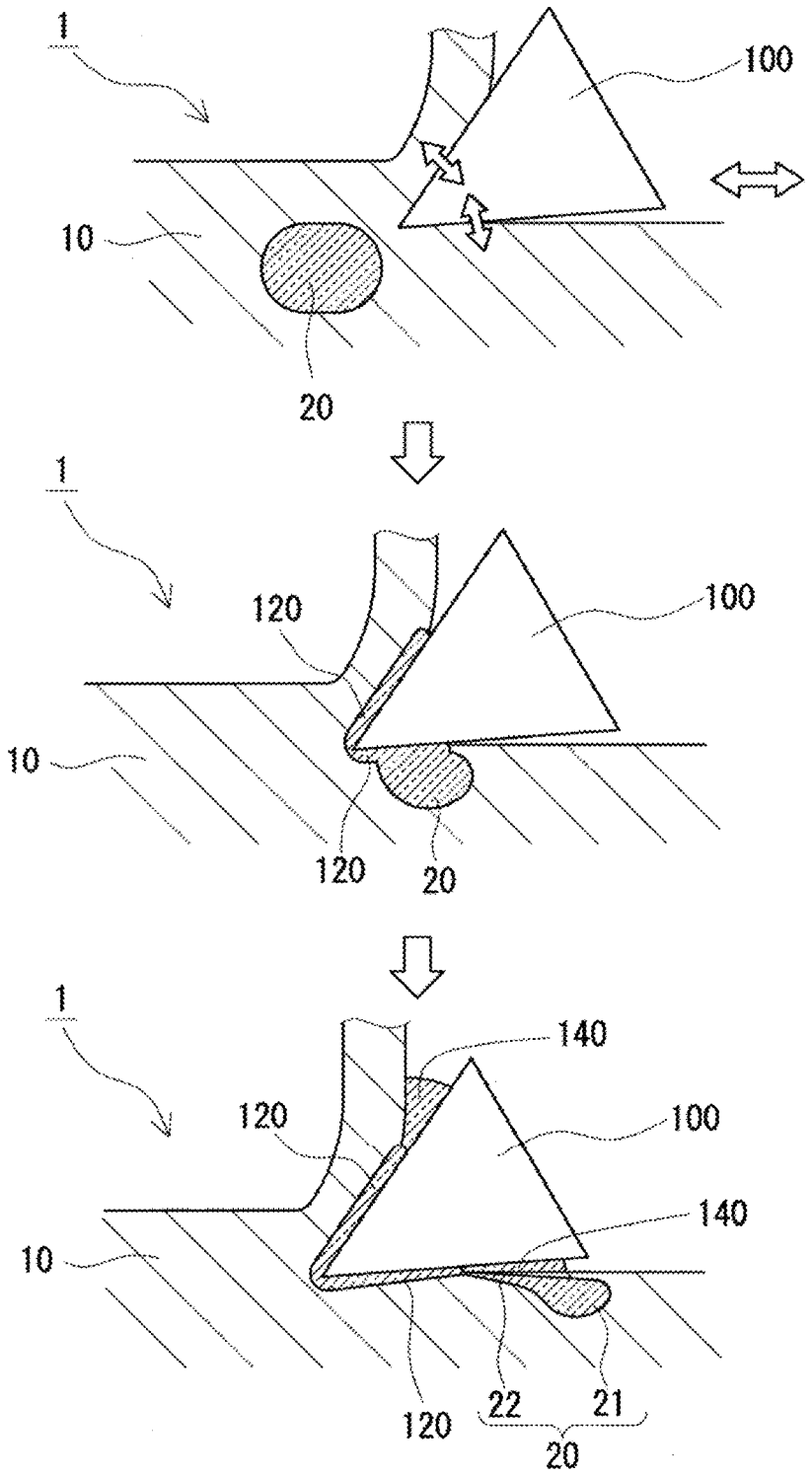
FIG. 18 shows schematic illustrations showing the states of complex oxide during cutting of a sintered body according to an embodiment.

As described above, in each of the sintered bodies of samples Nos. 1 to 6, the adhesion of Fe forming the base of the sintered body to a cutting tool is prevented. This can prevent the adhesive wear of the cutting tool, and the amount of wear of the flank of the cutting tool can be reduced. The mechanism that the adhesion of Fe to a cutting tool is prevented in each of the sintered bodies of samples Nos. 1 to 6 will be described with reference to FIG. 18.

When the iron-based sintered body 1 of sample No. 1 (hereinafter referred to simply as the sintered body) is subjected to cutting using a cutting tool 100, the cutting edge of the cutting tool 100 is heated to about 400 to about 920° C., and this depends on the composition of the sintered body 1. When the temperature of the cutting edge of the cutting tool 100 increases, interdiffusion of the constituent elements of the sintered body 1 and the constituent elements of the cutting tool 100 occurs as shown in the upper part of FIG. 18. The sintered body 1 includes a complex oxide 20 having a specific composition. When the cutting tool 100 comes into contact with the complex oxide 20, the complex oxide 20 is heated to the temperature of the cutting edge of the tool and thereby softened. Since the heat-softened the complex oxide 20 is reduced in viscosity and increased in flowability, the complex oxide 20 covers the surface of the cutting edge of the cutting tool 100 and forms a coating 120 as shown in the middle part of FIG. 18. The coating 120 is interposed between the sintered body 1 (a base portion 10) and the cutting tool 100 and therefore serves as a diffusion prevention film that prevents the interdiffusion of the constituent elements of the sintered body 1 and the constituent elements of the cutting tool 100. The coating 120 serves also as an adhesion prevention film (release film) that prevents adhesion of Fe to the cutting edge of the cutting tool. As the cutting of the sintered body 1 proceeds, the coating 120 formed on the surface of the cutting edge flows along the flank and rake face of the cutting tool 100 and adheres as residence portions 140, as shown in the lower part of FIG. 18. Since the complex oxide 20 is uniformly distributed in the sintered body 1 (see FIGS. 1 to 12), the following (1) to (3) occur successively. (1) The cutting tool 100 comes into contact with the complex oxide 20. (2) The complex oxide 20 is heat-softened to form a coating 120. (3) The coating 120 serving as the diffusion prevention film and the release film forms residence portions 140. Since the complex oxide 20 is in the state described above, the coating 120 is always formed on the surface of the cutting edge of the cutting tool 100, and the adhesion of Fe to the cutting tool 100 can thereby be prevented.

<<Cutting Test 2>>

A side surface of each of the sintered bodies of samples Nos. 1 and 101 obtained was cut using a lathe. The cutting conditions are as follows. A cutting tool using a cermet-made grooving tool was used, and wet cutting was performed at a cutting speed of 200 m/min, a feed of 0.1 mm/rev, and a cutting depth of 0.2 mm.

Observation of Machined Cross Section of Sintered Body

Figure 19:
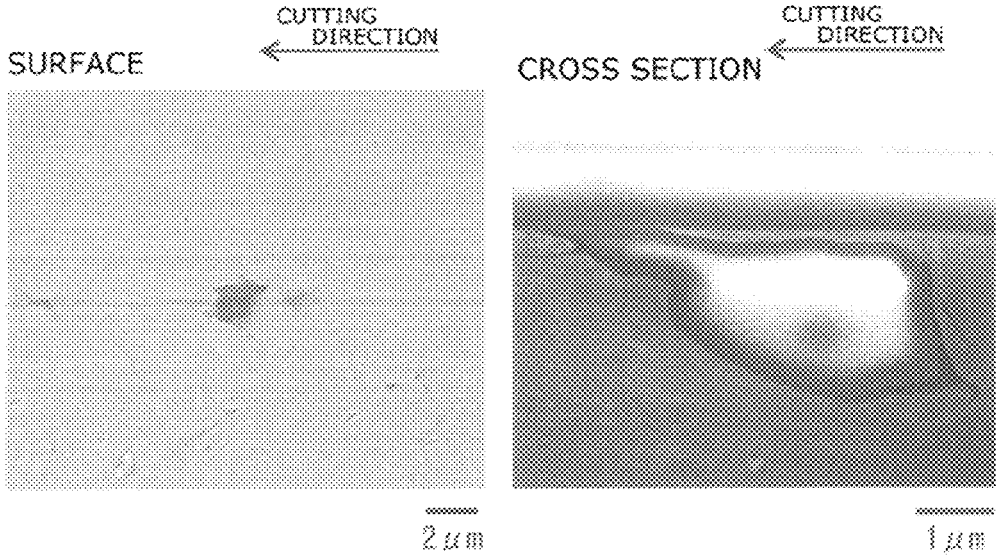
FIG. 19 shows field emission scanning electron microscope photographs showing a surface and cross section of sample No. 1 after cutting in cutting test 2.
Figure 20:
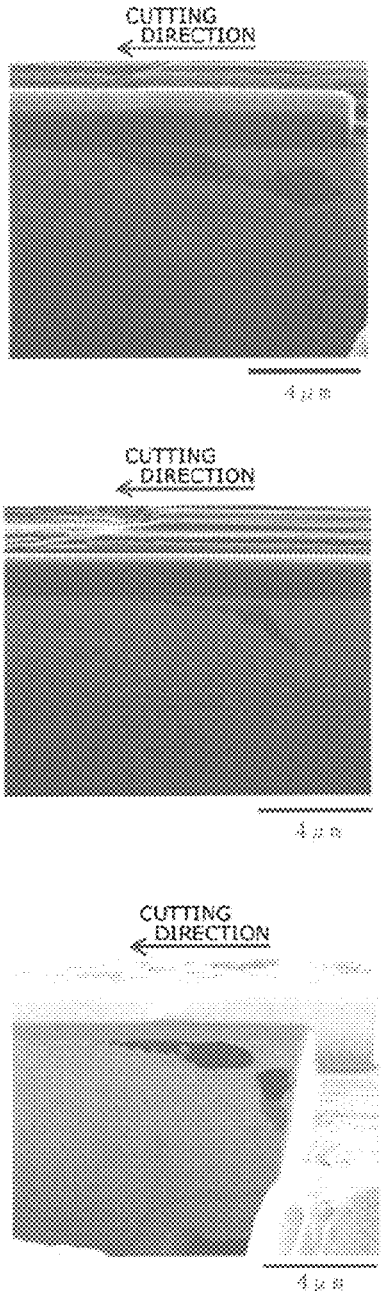
FIG. 20 shows field emission scanning electron microscope photographs showing cross sections of sample No. 1 in cutting test 2 after cutting, these cross sections being different from that in FIG. 19.
Figure 21:
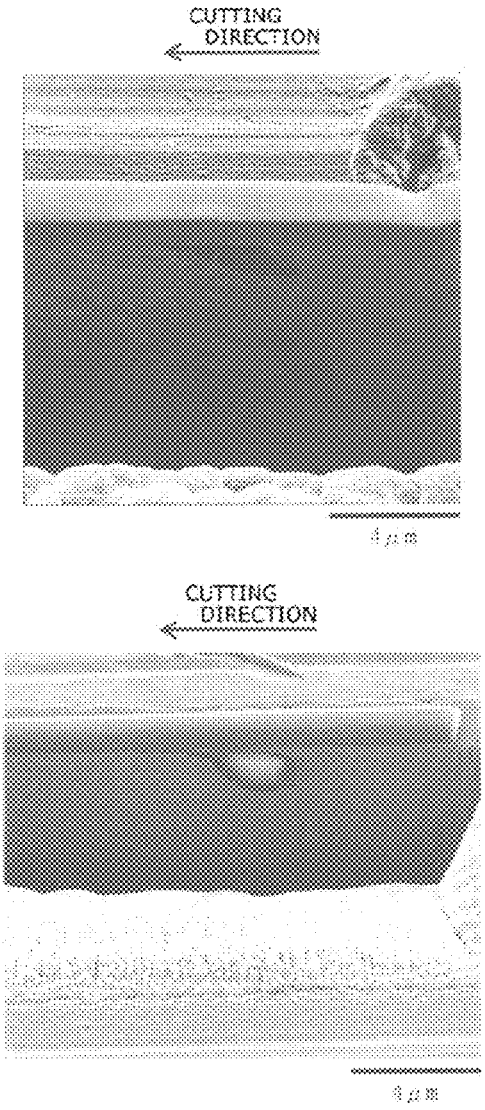
FIG. 21 shows field emission scanning electron microscope photographs showing cross sections of sample No. 1 after cutting in cutting test 2, these cross sections being different from those in FIGS. 19 and 20.

To examine the influence of the composition of a complex oxide on machinability, the machined cross section of a sintered body after cutting was observed. FIG. 19 shows field emission scanning electron microscope photographs (10,000×) of the surface of sample No. 1 after cutting and a cross section of a complex oxide particle observed on the surface, the cross section being obtained by focused ion beam (FIB) processing. A dark portion on the surface in the left photograph is the complex oxide particle. As shown in the cross section in the right photograph, the complex oxide particle has a shape including a portion buried in the sintered body within a surface region about 3 μm from the surface and an exposed extending portion extending from the buried portion in a cutting direction and exposed at the surface. Specifically, in sample No. 1, the complex oxide particle is stretched in the cutting direction. FIGS. 20 and 21 show cross sections of complex oxide particles in sample No. 1 that are different from the above complex oxide particle. Each of these complex oxide particles has a shape including a portion buried in the sintered body within a surface region about 3 mm from the surface and an exposed extending portion extending from the buried portion in the cutting direction and exposed at the surface and is stretched in the cutting direction.

Figure 22:
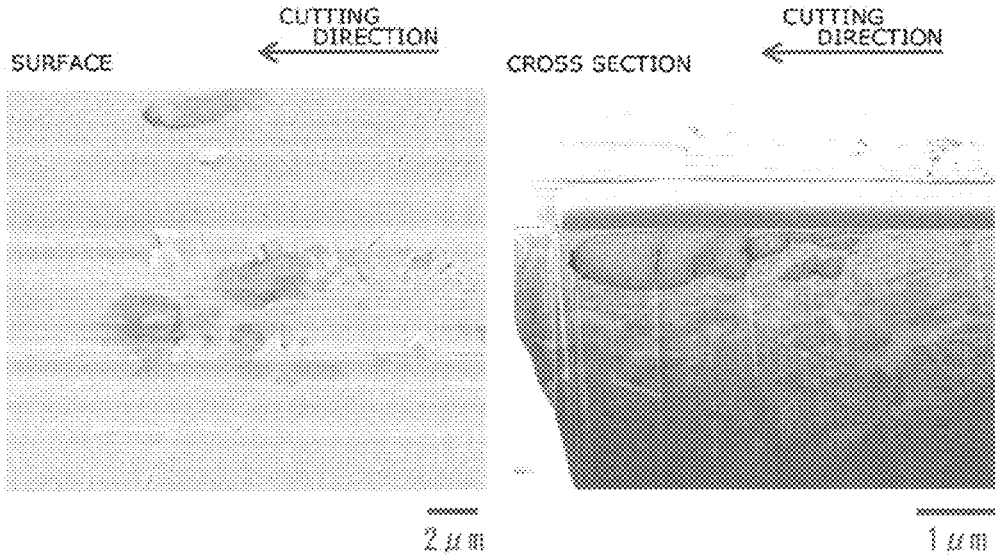
FIG. 22 shows field emission scanning electron microscope photographs showing a surface and cross section of sample No. 101 after cutting in cutting test 2.
Figure 23:
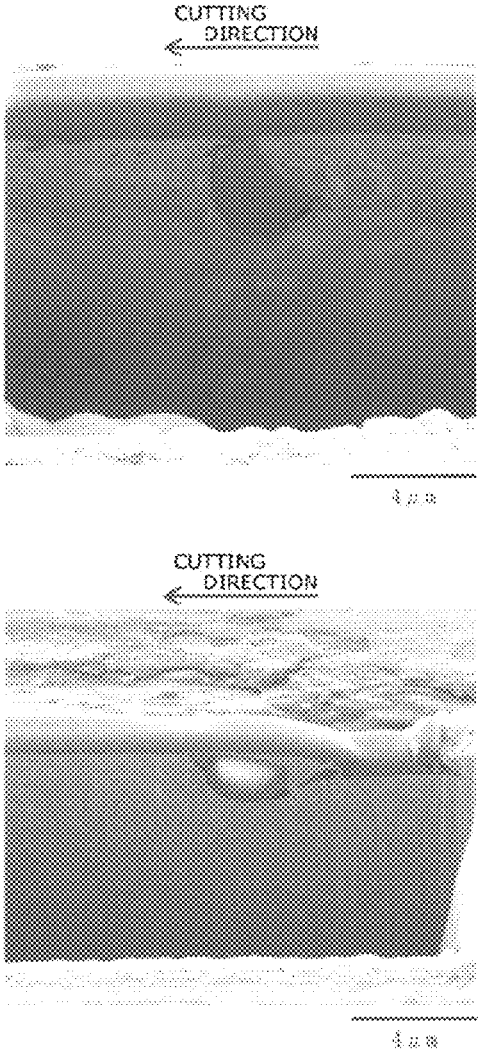
FIG. 23 shows field emission scanning electron microscope photographs showing cross sections of sample No. 101 after cutting, these cross sections being different from that in FIG. 22.

FIG. 22 shows field emission scanning electron microscope photographs (10,000×) of the surface of sample No. 101 after cutting and a cross section of a complex oxide particle observed on the surface, the cross section being obtained by FIB processing. A dark portion on the surface in the left photograph is the complex oxide particle. In the cross section in the right photograph, the complex oxide particle does not have a portion extending in the cutting direction and is cracked. FIG. 23 shows cross sections of complex oxide particles in sample No. 101 that are different from the above complex oxide particle. Each of these complex oxide particles does not extend in the cutting direction and is cracked.

As can be seen from the above, in the sintered body of sample No. 1, the complex oxide has the specific composition and has a low glass transition point and a low softening point. Therefore, the complex oxide is heat-softened at the temperature of the cutting edge of the tool during cutting and extends in the cutting direction. The heat-softened complex oxide serves as a lubricant. This may allow mechanical wear (rubbing wear) to be reduced, and the wear of the tool may thereby be significantly reduced.

Cutting Resistance

Figure 24:
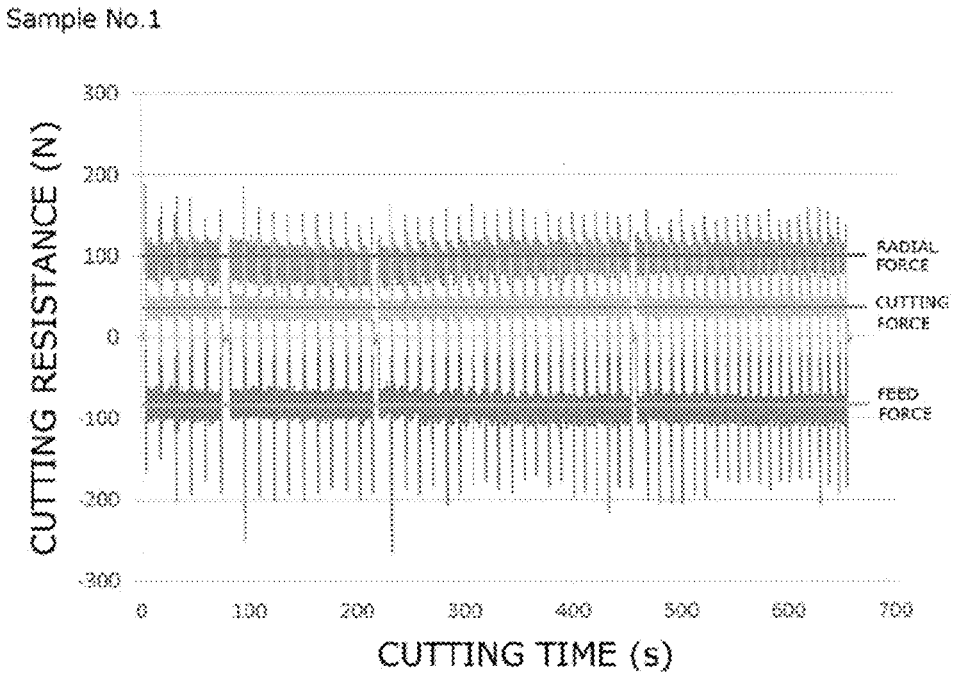
FIG. 24 is a graph showing temporal changes in the cutting resistance of sample No. 1 in cutting test 2.
Figure 25:
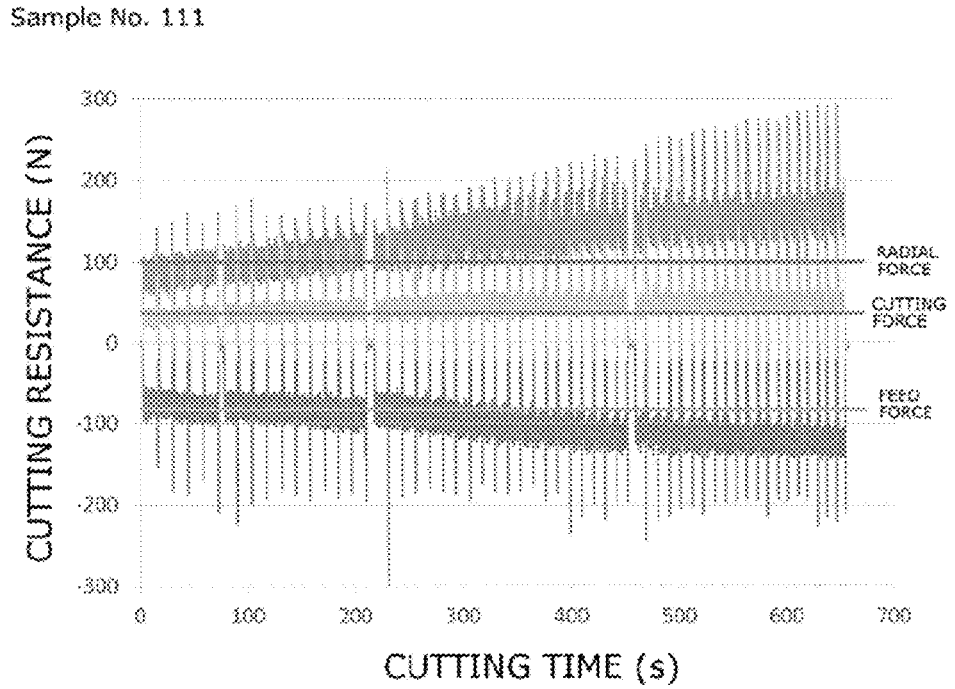
FIG. 25 is a graph showing temporal changes in the cutting resistance of sample No. 111 in cutting test 2.

For each of the sintered bodies of samples Nos. 1 and 111, the cutting resistance when cutting was performed under the above-described conditions was measured. In this example, a Kistler cutting force dynamometer (force sensor) was used to measure radial force, cutting force, and feed force. FIG. 24 shows the temporal changes of the cutting resistance of sample No. 1, and FIG. 25 shows the temporal changes of the cutting resistance of sample No. 111. In each of these figures, the horizontal axis represents cutting time, and the vertical axis represents cutting resistance. In each of these figures, the upper graph shows the radial force, the middle graph shows the cutting force, and the lower graph shows the feed force. In each of these figures, a horizontal line for each force is a reference line with respect to the force at the beginning of the machining. As can be seen from FIGS. 24 and 25, at the beginning of the machining, the cutting resistance (the radial force, cutting force, and feed force) of sample No. 1 containing the complex oxide is substantially the same as that of sample No. 111 containing no complex oxide, and the effect of reducing the cutting resistance by the addition of the complex oxide is not found. This is because of the following reason. Since sample No. 1 contains the complex oxide, sample No. 1 has the ability to reduce the wear of the tool while the cutting resistance is at the same level as that of sample No. 111 without deterioration in mechanical properties. In sample No. 1 containing the complex oxide, the cutting resistance at the beginning of the machining is almost unchanged even when the cutting is continued and the cutting length increases. However, in sample No. 111 containing no complex oxide, as the cutting length increases, the cutting resistance (radial force) increases from that at the beginning of the machining. This may be because of the following reason. In sample No. 1, the complex oxide provides the lubricating function, and this allows the tool wear to be reduced. However, in sample No. 111, the tool wear increases because no complex oxide is contained. The mechanism that the complex oxide in the sintered body of sample No. 1 is stretched in the cutting direction will be described with reference to FIG. 18.

When the iron-based sintered body 1 of sample No. 1 (hereinafter referred to simply as the sintered body) is subjected to cutting using the cutting tool 100, the temperature of the cutting edge of the cutting tool 100 is increased to about 400 to about 920° C., and this depends on the composition of the sintered body 1. When the cutting tool 100 comes into contact with the complex oxide 20, the complex oxide 20 is heat-softened at the temperature of the cutting edge of the tool, and the heat-softened complex oxide 20 is reduced in viscosity and increased in flowability. The heat-softened complex oxide 20 is stretched so as to follow the cutting edge of the cutting tool 100 as shown in the lower part of FIG. 18. Therefore, the complex oxide 20 is deformed into an irregular shape including a buried portion 21 buried in the base portion 10 of the sintered body 1 within an inner portion spaced apart from the cutting tool and an exposed extending portion 22 extending from the buried portion 21 in the cutting direction and exposed at the surface. Since the complex oxide 20 is uniformly distributed in the sintered body 1 (see FIGS. 1 to 12), the cutting tool 100 is always in contact with exposed extending portions 22 of the complex oxide 20. Since the complex oxide 20 serves as a lubricant, the machinability is expected to be improved.

<<Cutting Test 3>>

For each of the sintered bodies of samples Nos. 1 to 3, 101, and 111, the same cutting test as the above-described cutting test 2 was repeated until the cutting tool was worn away and caused abnormality in machined surface quality such as cloudiness and stripping to occur on the machined surface or a burr to be formed on the machined end surface. The tool life was determined as the number of cut sintered bodies until the cutting tool was worn away. It was found that the tool life was 244 for the sintered body of No. 1, 210 for the sintered body of sample No. 2, 152 for the sintered body of sample No. 3, 47 for the sintered body of sample No. 101, and 95 for the sintered body of sample No. 111. As can be seen from the above results, with the sintered bodies of samples Nos. 1 to 3, the tool life can be improved significantly.

The amounts of elements in a sintered body after cutting were measured by ICP (Inductively Coupled Plasma) analysis. The amount of C was found to be 0.75% by mass, and the amount of Cu was found to be 2.0% by mass.

As can be seen from the results of the above-described cutting tests, when a complex oxide having a specific composition is uniformly distributed in a sintered body, its machinability can be improved, and the life of a tool can be improved. The reason for this is as follows. As shown by the observation of the cutting edge of a cutting tool and the observation of the machined surface of a sintered body, when the complex oxide is heat-softened at the temperature of the cutting edge of the tool during cutting of the sintered body, the complex oxide exhibits the following two functions. (1) The heat-softened complex oxide covers the surface of the cutting edge of the cutting tool to form a coating. This can prevent adhesion of Fe to the cutting tool, and adhesive wear is thereby reduced. (2) The heat-softened complex oxide is stretched so as to follow the cutting edge of the cutting tool and therefore exhibits the lubricating function that allows slidability to be improved, and the mechanical wear (rubbing wear) etc. of the working tool is thereby significantly reduced. In particular, since the complex oxide is present uniformly in the sintered body, the cutting tool can be always in contact with the complex oxide, and this allows the machinability to be effectively improved.

The present invention is not limited to the above examples but is defined by the claims. The present invention is intended to include any modifications within the scope of the claims and meaning equivalent to the scope of the claims. For example, in the Test Examples described above, at least one of the compositions of the powders forming the iron-based sintered body, the grain diameters of the powders, and the production conditions may be changed. As for the compositions, for example, the content of at least one element selected from Si, Al, Ca, and O may be changed, or an element selected from B, Mg, Na, Mn, Sr, Ti, Ba, and Zn may be contained within a specific range.

REFERENCE SIGNS LIST

1 sintered body
1O base portion, 20 complex oxide, 21 buried portion
22 exposed extending portion
100 cutting tool, 120 coating, 140 residence portion

The invention claimed is:

1. An iron-based sintered body comprising a metal matrix and complex oxide particles contained in the metal matrix, wherein, when a main viewing field having an area of 176 μm×226 μm is taken on a cross section of the iron-based sintered body and divided into a 5×5 array of 25 viewing fields each having an area of 35.2 μm×45.2 μm, the complex oxide particles have an average equivalent circle diameter from 0.3 μm to 2.5 μm inclusive, a value obtained by dividing the total area of the 25 viewing fields by the total number of complex oxide particles present in the 25 viewing fields is from 10 $\mu m^2$/particle to 1,000 $\mu m^2$/particle inclusive, and the number of viewing fields in which no complex oxide particle is present is 4 or less out of the 25 viewing fields, wherein the complex oxide contains from 45% to 99.8% inclusive of Si, Al, Ca, and O based on the total mass of the complex oxide; and wherein the complex oxide contains, in % by mass,
from 4% to 35% inclusive of Si,
from 2% to 15.5% inclusive of Al,
from 2% to 35% inclusive of Ca, and
from 35% to 55% inclusive of O.

2. The iron-based sintered body according to claim 1, wherein the iron-based sintered body contains Mn in an amount from 0.05% by mass to 0.35% by mass inclusive, and at least part of the Mn is bonded to the complex oxide or is present as a solute in the complex oxide.

3. The iron-based sintered body according to claim 2, wherein the iron-based sintered body further contains S in an amount from 0.001% by mass to 0.02% by mass inclusive, and at least part of the S is bonded to at least one of the complex oxide and the Mn or is present as a solute in at least one of the complex oxide and the Mn.

4. The iron-based sintered body according to claim 1, wherein, in a cross section of the iron-based sintered body that includes a surface region within 10 μm from a surface of the iron-based sintered body, the complex oxide particles include irregularly shaped particles each including a buried portion buried in the metal matrix and an exposed extending portion exposed at the surface and extending in one direction from the buried portion.

5. The iron-based sintered body according to claim 4, wherein the exposed extending portion is present within 3 μm from the surface of the ironbased sintered body.

6. The iron-based sintered body according to claim 1, wherein the complex oxide further contains at least one element selected from B, Mg, Na, Mn, Sr, Ti, Ba, and Zn, wherein the content, in % by mass, of the at least one element satisfies at least one of from 4% to 8% inclusive of B,
from 0.5% to 15% inclusive of Mg,
from 0.01% to 1% inclusive of Na,
from 0.01% to 0.3% inclusive of Mn,
from 0.01% to 1% inclusive of Sr,
from 0.3% to 8% inclusive of Ti,
from 2% to 25% inclusive of Ba, and
from 5% to 45% inclusive of Zn.

7. The iron-based sintered body according to claim 1, wherein the complex oxide contains at least 30% by mass of an amorphous component.

8. The iron-based sintered body according to claim 1, wherein the iron-based sintered body contains at least one element selected from C, Cu, Ni, Cr, and Mo.

9. The iron-based sintered body according to claim 8, wherein C is contained in an amount from 0.2% by mass to 3.0% by mass inclusive with respect to the total mass of the iron-based sintered body, and at least one element selected from Cu, Ni, Cr, and Mo is contained in a total amount from 0.5% by mass to 6.5% by mass inclusive with respect to the total mass of the iron-based sintered body.

10. An iron-based sintered body comprising a metal matrix and complex oxide particles contained in the metal matrix, wherein, when a main viewing field having an area of 176 μm×226 μm is taken on a cross section of the iron-based sintered body and divided into a 5×5 array of 25 viewing fields each having an area of 35.2 μm×45.2 μm, the complex oxide particles have an average equivalent circle diameter from 0.3 μm to 2.5 μm inclusive, a value obtained by dividing the total area of the 25 viewing fields by the total number of complex oxide particles present in the 25 viewing fields is from 10 $\mu m^2$/particle to 1,000 $\mu m^2$/particle inclusive, and the number of viewing fields in which no complex oxide particle is present is 4 or less out of the 25 viewing fields, wherein the complex oxide contains from 45% to 99.8% inclusive of Si, Al, Ca, and O based on the total mass of the complex oxide, wherein the complex oxide has a glass transition point of 725° C. or lower and a softening point of 950° C. or lower, and wherein the complex oxide contains, in % by mass,
from 4% to 35% inclusive of Si,
from 2% to 15.5% inclusive of Al,
from 2% to 35% inclusive of Ca, and
from 35% to 55% inclusive of O.

11. The iron-based sintered body according to claim 10, wherein the iron-based sintered body contains Mn in an amount from 0.05% by mass to 0.35% by mass inclusive, and at least part of the Mn is bonded to the complex oxide or is present as a solute in the complex oxide.

12. The iron-based sintered body according to claim 11, wherein the iron-based sintered body further contains S in an amount from 0.001% by mass to 0.02% by mass inclusive, and at least part of the S is bonded to at least one of the complex oxide and the Mn or is present as a solute in at least one of the complex oxide and the Mn.

13. The iron-based sintered body according to claim 10, wherein, in a cross section of the iron-based sintered body that includes a surface region within 10 μm from a surface of the iron-based sintered body, the complex oxide particles include irregularly shaped particles each including a buried portion buried in the metal matrix and an exposed extending portion exposed at the surface and extending in one direction from the buried portion.

14. The iron-based sintered body according to claim 13, wherein the exposed extending portion is present within 3 μm from the surface of the iron-based sintered body.

15. The iron-based sintered body according to claim 10, wherein the complex oxide further contains at least one element selected from B, Mg, Na, Mn, Sr, Ti, Ba, and Zn, wherein the content, in % by mass, of the at least one element satisfies at least one of
from 4% to 8% inclusive of B,
from 0.5% to 15% inclusive of Mg,
from 0.01% to 1% inclusive of Na,
from 0.01% to 0.3% inclusive of Mn,
from 0.01% to 1% inclusive of Sr,
from 0.3% to 8% inclusive of Ti,
from 2% to 25% inclusive of Ba, and
from 5% to 45% inclusive of Zn.

16. The iron-based sintered body according to claim 10, wherein the complex oxide contains at least 30% by mass of an amorphous component.

17. The iron-based sintered body according to claim 10, wherein the iron-based sintered body contains at least one element selected from C, Cu, Ni, Cr, and Mo, wherein C is contained in an amount from 0.2% by mass to 3.0% by mass inclusive with respect to the total mass of the iron-based sintered body, and at least one element selected from Cu, Ni, Cr, and Mo is contained in a total amount from 0.5% by mass to 6.5% by mass inclusive with respect to the total mass of the iron-based sintered body.

* * * * *